US011558691B2

(12) United States Patent
DeLay

(10) Patent No.: US 11,558,691 B2
(45) Date of Patent: Jan. 17, 2023

(54) LOUDSPEAKER ARRAY CABINET

(71) Applicant: MTD Designs L.L.C., St Paul, MN (US)

(72) Inventor: Mark T. DeLay, St Paul, MN (US)

(73) Assignee: MTD DESIGNS L.L.C., St. Paul, MN (US)

( * ) Notice: Subject to any disclaimer, the term of this patent is extended or adjusted under 35 U.S.C. 154(b) by 326 days.

(21) Appl. No.: 16/797,521

(22) Filed: Feb. 21, 2020

(65) Prior Publication Data

US 2020/0275196 A1 Aug. 27, 2020

Related U.S. Application Data

(60) Provisional application No. 62/809,358, filed on Feb. 22, 2019.

(51) Int. Cl.

| | |
|---|---|
| ***H04R 5/02*** | (2006.01) |
| ***H04R 1/02*** | (2006.01) |
| ***H04R 1/34*** | (2006.01) |
| ***H04R 1/30*** | (2006.01) |
| ***H04R 7/12*** | (2006.01) |
| ***H04R 1/40*** | (2006.01) |
| ***H04R 1/26*** | (2006.01) |
| ***H04R 9/06*** | (2006.01) |
| ***H04R 3/14*** | (2006.01) |

(52) U.S. Cl.

CPC ..... *H04R 1/345* (2013.01); *H04R 1/025* (2013.01); *H04R 1/26* (2013.01); *H04R 1/30* (2013.01); *H04R 1/403* (2013.01); *H04R 3/14* (2013.01); *H04R 7/127* (2013.01); *H04R 9/06* (2013.01)

(58) Field of Classification Search

CPC ..... H04R 1/02; H04R 1/025; H04R 1/026; H04R 2201/403

USPC ..... 381/87, 332, 334–336

See application file for complete search history.

(56) References Cited

U.S. PATENT DOCUMENTS

| | | | |
|---|---|---|---|
| 4,369,857 | A | 1/1983 | Frazer et al. |
| 4,685,532 | A | 8/1987 | Gunness |
| 4,718,517 | A | 1/1988 | Carlson |
| 4,969,196 | A | 11/1990 | Nakamura |
| 5,778,084 | A | 7/1998 | Kling et al. |
| 6,016,353 | A | 1/2000 | Gunness |

(Continued)

FOREIGN PATENT DOCUMENTS

| | | |
|---|---|---|
| EP | 1333698 | 8/2003 |
| WO | 2015168520 | 11/2015 |

*Primary Examiner* — George C Monikang

(74) *Attorney, Agent, or Firm* — Schwegman Lundberg & Woessner, P.A.

(57) ABSTRACT

A substantially full-range loudspeaker system for acoustic sound reinforcement can include a woofer section with a first loudspeaker driver configured to reproduce audio signals in a first frequency range and a controlled-directivity horn section configured to reproduce other audio signals in a different second frequency range. In an example, the horn section includes a second loudspeaker driver comprising a cone-diaphragm transducer and a dust dome, an acoustic lens having a first side and an opposite second side, wherein the first side of the lens is coupled to a sound-projecting face of the second loudspeaker driver, and a waveguide coupled to the second side of the lens, wherein the waveguide comprises walls that follow arcuate paths in horizontal and vertical planes.

20 Claims, 20 Drawing Sheets

(56) References Cited

U.S. PATENT DOCUMENTS

| | | | | |
|---|---|---|---|---|
| 6,094,495 | A | 7/2000 | Rocha | |
| 6,112,847 | A | 9/2000 | Lehman | |
| 6,394,223 | B1 | 5/2002 | Lehman | |
| 7,903,834 | B1 * | 3/2011 | Graber | H04R 1/403 381/334 |
| 2004/0156519 | A1 | 8/2004 | Geddes | |
| 2008/0085027 | A1 | 4/2008 | Engebretson et al. | |
| 2010/0322445 | A1 | 12/2010 | Jakowski | |
| 2011/0069856 | A1 | 3/2011 | Blore et al. | |
| 2015/0201279 | A1 * | 7/2015 | Sprinkle | H04R 1/00 381/162 |

* cited by examiner

LOUDSPEAKER ARRAY CABINET

CROSS-REFERENCE TO RELATED APPLICATIONS

This application is related to and claims priority to U.S. Provisional Application No. 62/809,358, filed on Feb. 22, 2019, and entitled "Loudspeaker Array Cabinet," the entirety of which is incorporated herein by reference.

BACKGROUND

Sound reinforcement systems can be provided for amplified playback of various sound sources or instruments, such as guitar, bass guitar, keyboards, drum machines, various other stringed instruments, or other acoustic sources. In an example, a sound reinforcement system includes a loudspeaker or speaker system that can include multiple enclosures, such as can be stacked, placed side by side, or otherwise used together. In an example, an internal or external power amplifier can be used to power speakers in one or more of the enclosures. In an example, transducers in the enclosures can receive respective input signals from a power amplifier.

In an example, a system includes different enclosures for different bands of audio signals. For example, a first enclosure or section can be a low frequency section and a second enclosure or second can be a mid/high frequency section. Each section can be differently or separately controlled. In an example, response or output characteristics of the low frequency section can be controlled by a tuned port. In an example, response or output characteristics of the mid/high frequency section can be controlled by a phase plug, a horn, or transducer alignment, such as vertical stacking, to control acoustic output of the system.

In some examples that include a horn, an acoustic transformer or phase plug can be used to tune an acoustic output from a loudspeaker. In an example, a phase plug can include an insert configured to be fit at least partially inside of a concavity defined by a loudspeaker cone diaphragm, and can be positioned in proximity to the speaker diaphragm. Such a phase plug can help bring different portions of sound waves generated by the diaphragm into coherence at the loudspeaker outlet.

BRIEF SUMMARY

The present inventor has recognized that a problem to be solved includes providing an instrument cabinet that is suitable for use in sound reproduction, such as following a signal chain modeler, and such as can be configured for live sound applications. For example, conventional guitar and bass guitar sound reinforcement systems, such as loudspeaker cabinets with multiple conventional cone drivers, such as a 4×12" driver arrangement, can be inadequate for signal chain modeling and live sound reinforcement. A solution to the problem can include or use the loudspeakers and/or cabinets and/or arrangements discussed herein. For example, a system according to the present disclosure can be configured to provide sufficient acoustical power to project sound toward or into an audience, and the system can have a suitable polar response, such as due to a crossover and/or a mid/high horn. In an example, this system can be powered by a professional amplifier such that the system can be integrated with various front of house systems. In an example, the system can receive power or input signal from an emulator or similar processor and can provide a full bandwidth output. That is, the system can be configured to be substantially transparent such that instrument sounds that can be pre-processed to sound a particular way can be reproduced by the system without additional coloration.

In an example, a solution to the above-described problem can include or use a substantially full-range loudspeaker system for acoustic sound reinforcement. The system can include a woofer section and a controlled-directivity (or substantially constant-directivity) horn section. In an example, the woofer section can include a first loudspeaker driver configured to reproduce audio signals in a first frequency range. The horn section can be configured to reproduce other audio signals in a different second frequency range. The horn section can include, among other things, a second loudspeaker driver comprising a cone-diaphragm transducer and a dust dome, an acoustic lens having a first side and an opposite second side, wherein the first side of the lens is coupled to a sound-projecting face of the second loudspeaker driver; and a waveguide coupled to the second side of the lens, wherein the waveguide comprises walls that follow arcuate paths in horizontal and vertical planes. In an example, the woofer section can include a baffle configured to receive the first loudspeaker driver, and the baffle has a baffle central axis. The waveguide can have a waveguide central axis in the vertical plane of the waveguide, and the baffle central axis and the waveguide central axis can be substantially parallel and transversely spaced apart.

This summary is intended to provide an overview of subject matter of the present patent application. It is not intended to provide an exclusive or exhaustive explanation of the invention. The detailed description is included to provide further information about the present patent application.

BRIEF DESCRIPTION OF THE SEVERAL VIEWS OF THE DRAWINGS

In the drawings, which are not necessarily drawn to scale, like numerals may describe similar components in different views. The drawings illustrate generally, by way of example, but not by way of limitation, various embodiments discussed in the present document.

DETAILED DESCRIPTION

Figure 1:
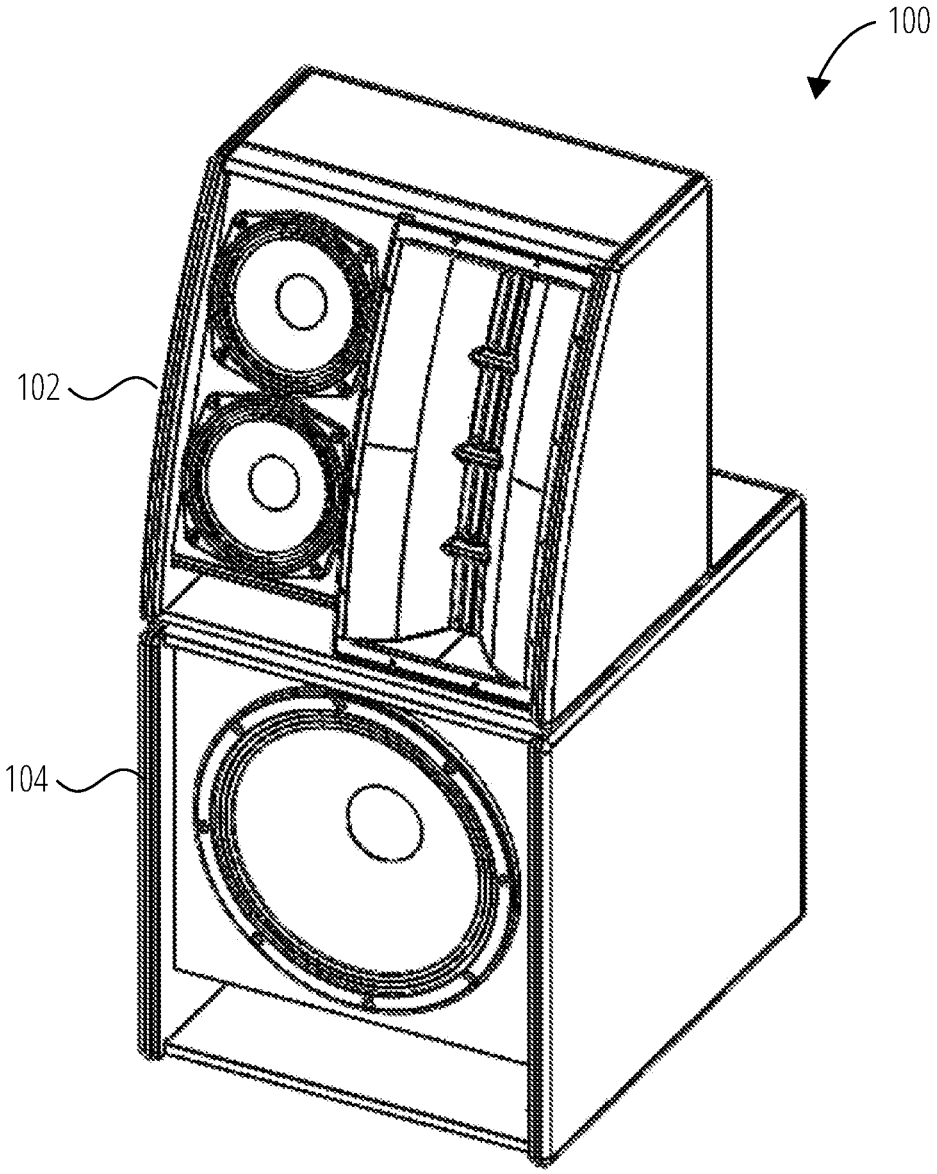
FIG. 1 illustrates a loudspeaker system in accordance with one example.

In an example, a loudspeaker system or sound reinforcement cabinet can be provided. The loudspeaker system can be characterized by a substantially full-range response and controlled-directivity of its acoustic output. In an example, the full-range response can include acoustic signals from about 20 Hz to about 20,000 Hz.

The term "directivity" is used herein to describe a way in which acoustic information from a loudspeaker system, or a frequency response of the system, behaves or changes at off-axis angles relative to a reference. Generally, a wide directivity system is one that can maintain a particular signal amplitude (e.g., sound pressure level) between the on-axis and off-axis information over a wide subtended angle. A narrow directivity system is one where on-axis and off-axis amplitudes are substantially maintained over a small subtended angle. In direct radiating systems, small wavelength or high frequency acoustic information can "beam" or become more directional in the on-axis direction. Lobes or lobing can occur at off-axis locations such as due to phase interaction.

In an example, a direction of acoustic output can be controlled, particularly at increasingly high frequencies, such that a listener or audience in a target zone can receive substantially all of the output acoustic information from the system. That is, a listener in the target zone can experience the substantially full-range output of the loudspeaker system. In an example, the target zone can include an area that extends horizontally and vertically from a front or sound-projecting side of the system, such as from about 1 meter in front of the system.

In an example, the loudspeaker system can be configured as an instrument cabinet for signal chain modeling or live sound applications. For example, conventional guitar and bass guitar sound reinforcement systems, such as loudspeaker cabinets with multiple conventional cone drivers, such as can include a 4×12" driver arrangement, can be inadequate for signal chain modeling or live sound environments, for example due to directivity or frequency response deficiencies. A solution to the problem can include or use the loudspeaker systems discussed herein and/or can include elements or features thereof. For example, a loudspeaker system according to the present disclosure can be configured to provide sufficient acoustic power to project sound toward or into an audience or to the source musician in a target zone. The system can have a suitable polar response that enables a full-range listening experience in the target zone, such as due to a crossover network and/or a mid/high frequency horn section that is tuned for coherence. In an example, the system can be powered by an amplifier or can be integrated with or usable together with various signal chain modelers or front of house systems.

In an example, the systems discussed herein can receive power or an input signal from an emulator or other signal processor and, in response, can provide a substantially full bandwidth or full-range acoustic output. That is, the loudspeaker system can be configured to be substantially transparent such that instrument information that may be pre-processed can be reproduced by the system without additional coloration that could otherwise affect the intended result of the pre-processing.

In an example, the loudspeaker system can be configured to split and extend a frequency response. The system can include a cabinet with a waveguide provided at an output of a woofer phase plug to produce a coherent wave front. In an example, the systems discussed herein can include a constant directivity horn to provide or maintain substantially constant dispersion in one or both of horizontal and vertical planes. In an example, the system is configured to receive amplified signals, such as from a professional audio amplifier that can include or use DSP (digital signal processing) in the audio chain. The constant directivity response, power output, as well as using a professional audio amplifier and signal chain, provide a system that can be used with signal chain modelers or on stage or mixed in with a front of house system.

In an example, an upper portion or upper cabinet of the system can include one or more transducers mounted at an angle that is selected or configured to facilitate a position and direction to provide an optimal polar response for effective projection into an audience or for personal reproduction. In an example, the upper portion, such as including a mid/high frequency section, can be vertically splayed to spread the vertical pattern across a specified angle.

FIG. 1 illustrates generally an example of a loudspeaker system 100. The loudspeaker system 100 can include a woofer and high frequency portion 102 and a subwoofer portion 104. In an example, the loudspeaker system 100 can be configured as a substantially full-range, controlled-directivity loudspeaker system. In an example, the system comprising the lower frequency woofer section and the mid-high frequency section provides an acoustic output with less distortion, improved beam width, and improved high frequency extension relative to conventional instrument speaker cabinets or conventional combinations of multiple cabinets.

The woofer and high frequency portion 102 can include or use loudspeaker drivers with cone-shaped diaphragms or can include or use compression drivers. In an example, the woofer and high frequency portion 102 can include a horn section comprising one or more loudspeaker transducers, a waveguide, and an acoustic lens or phase plug provided between each transducer and the waveguide. In an example, the high frequency portion 102 can include or use one or more direct radiating transducers.

In an example, the loudspeaker system 100 can receive an input signal and split (actively or passively) the input signal to send information to at least two different speaker sections, such as to the woofer and high frequency portion 102 and the subwoofer portion 104. The portions can be physically separate, such as comprising different speaker cabinets that can be stacked. In an example, one or both of the cabinets can include or use one or more tuned ports to help manage or tune reproduction of low frequency sounds.

High frequency sound information from an input signal can be provided to the woofer and high frequency portion 102 for reproduction using one or more drivers. In an example, the woofer and high frequency portion 102 can include or use one or more cone transducers, phase plugs, diffraction beams, lenses, horns, waveguides, or combinations thereof. In an example, such as illustrated in the figures herein, the woofer and high frequency portion 102 can include four mid/high frequency cone transducers, and each transducer can have a respective phase plug or lens coupled to a common directivity waveguide. Other embodiments can similarly be used, such as using fewer or additional transducers.

In an example, a cabinet according to the present disclosure can have multiple cabinet sections for mobility and ease of use. In other examples, the various configurations can be integrated into a single cabinet. In an example, one or more of the cabinet sections can have a size or shape that can be the same or similar to a traditional 2×12" guitar cabinet (e.g., having a front area of about 20"×30"). In an example, the lower section cabinet, such as comprising the subwoofer portion 104, can be rectangular and, in an example, does not include any offset in a facing direction of the low frequency transducers therein. That is, the lower section can have a transducer mounting baffle that is vertical, rather than sloped.

Figure 2:
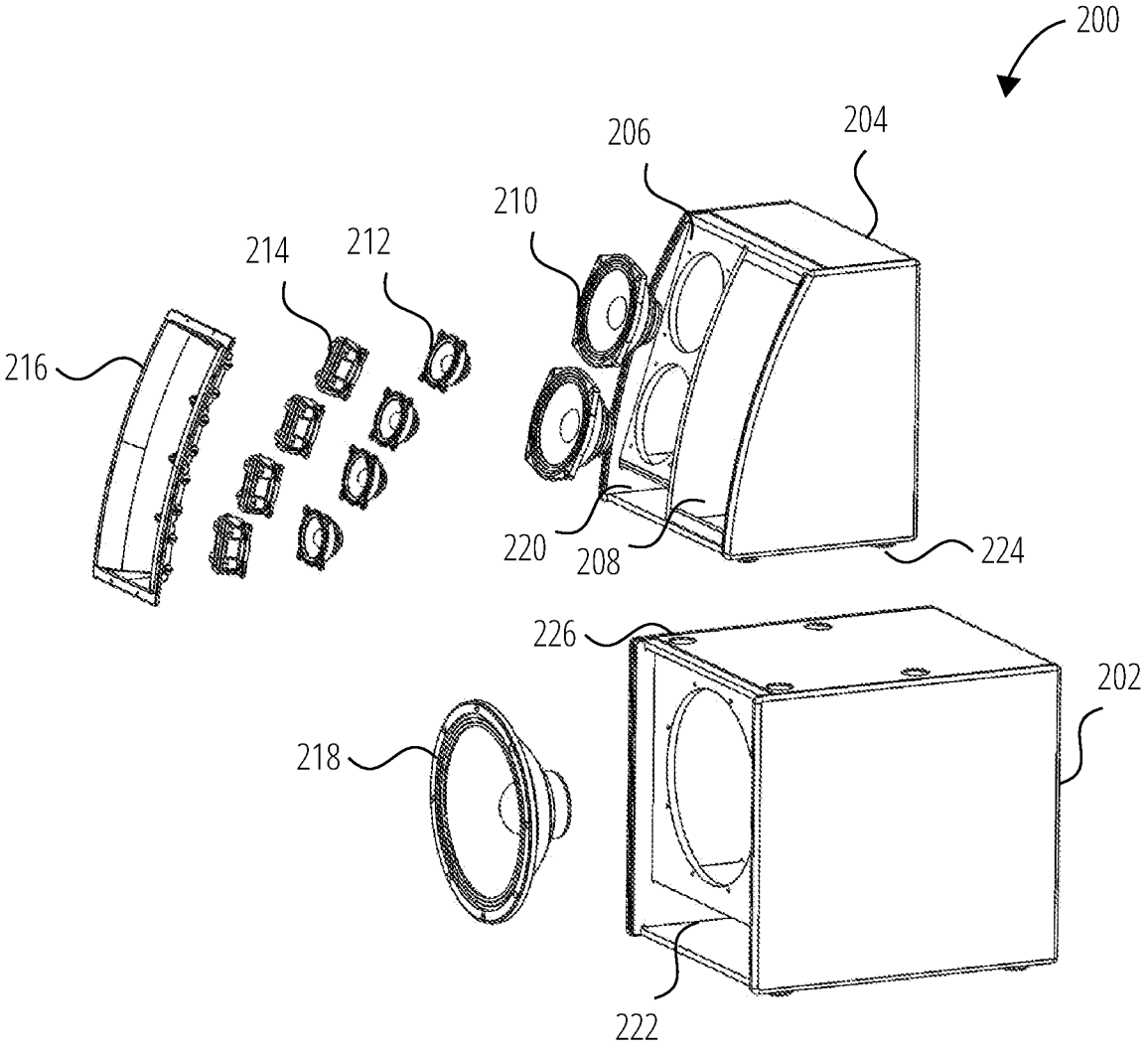
FIG. 2 illustrates a loudspeaker system exploded view in accordance with one example.

FIG. 2 illustrates generally a loudspeaker system exploded view 200 of the loudspeaker system 100. The loudspeaker system exploded view 200 illustrates that the woofer and high frequency portion 102 can, in an example, be detachable from or coupled to the subwoofer portion 104.

In an example, the subwoofer portion 104 can include a subwoofer cabinet 202 including a subwoofer cabinet port 222, a subwoofer driver 218, and a foot receiver 226. The foot receiver 226 can include one or multiple features configured to align the subwoofer cabinet 202 with the woofer and high frequency cabinet 204 or with another cabinet or device.

In the example of FIG. 2, the woofer and high frequency portion 102 includes a woofer and high frequency cabinet 204 with a woofer cabinet port 220, a woofer baffle 206, a waveguide receiving portion 208, one or more mid-frequency woofer drivers 210, one or more high-frequency or full-range woofer drivers 212, one or more lenses 214, a waveguide 216, and a cabinet foot 224. The cabinet foot 224 and foot receiver 226 are configured to mate to provide a specified alignment or relationship between the one or more drivers in the subwoofer cabinet 202 and the one or more drivers in the woofer and high frequency cabinet 204.

The woofer baffle 206 forms, in part, a front face of the woofer and high frequency portion 102 of the loudspeaker system 100. In an example, the mid-frequency woofer drivers 210 are mounted to the woofer baffle 206. Along with holding the drivers in place, the woofer baffle 206 prevents sound from the front and the back of the drivers from destructive interference. In the various examples discussed herein, the woofer baffle 206 can be angled or offset relative to a vertical axis, such as to steer acoustic energy in a specified manner. In an example, the woofer baffle 206 can have about a 5 degree to 20 degree back tilt angle relative to a vertical reference plane.

Figure 3:
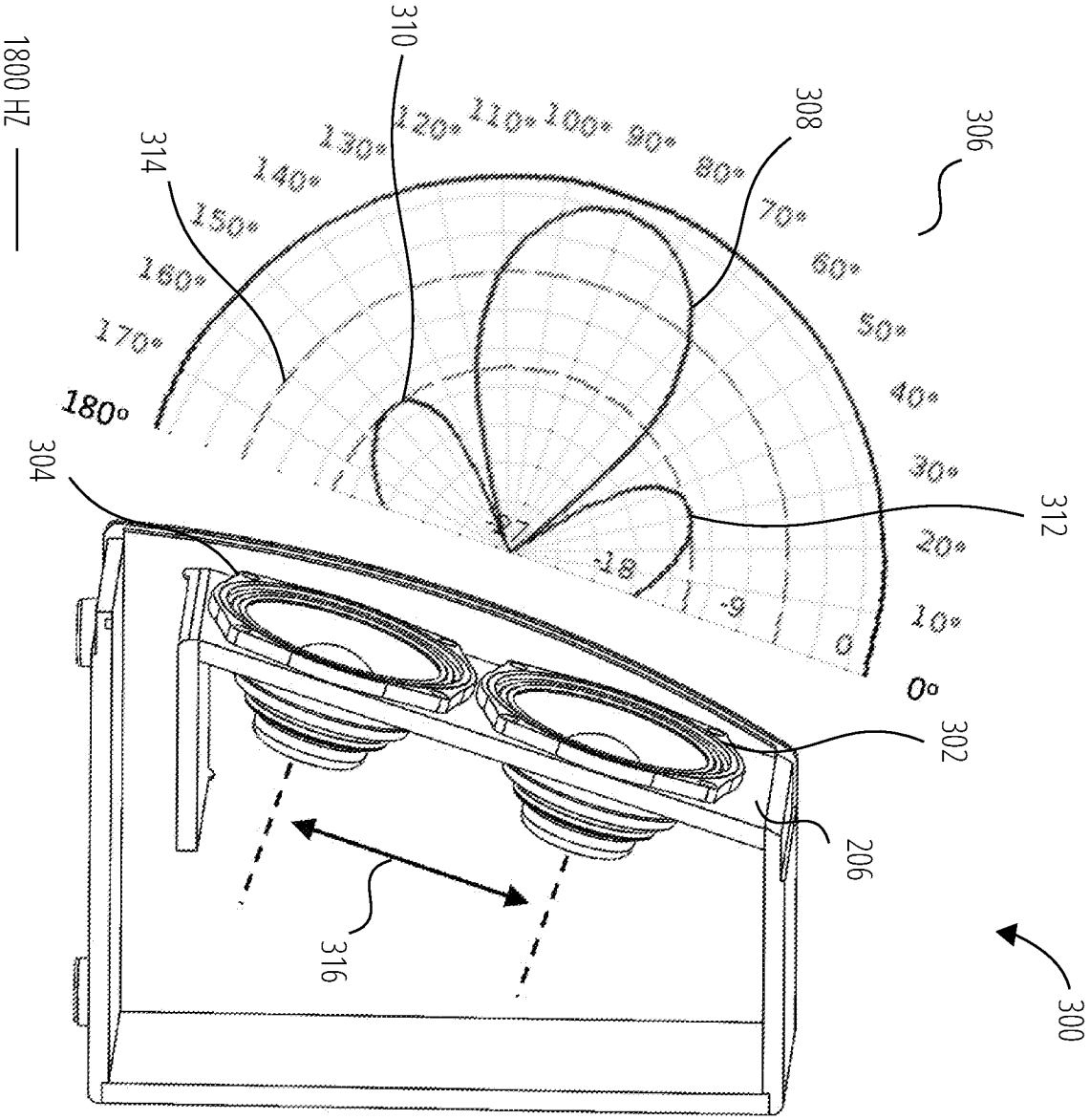
FIG. 3 illustrates a woofer polar response in accordance with one example.

FIG. 3 illustrates generally an example of a woofer polar response 300 such as for the one or more woofers in the woofer and high frequency cabinet 204 of the waveguide loudspeaker system 100. In the example of FIG. 3, the mid-frequency woofer drivers 210 include a first woofer 302 and a second woofer 304 coupled to the woofer baffle 206. The first woofer 302 and second woofer 304 can be substantially matched woofer drivers or can be differently configured. In the example of FIG. 3, the first woofer 302 and second woofer 304 can be substantially matched in terms of expected acoustic response and sensitivity. The woofer polar response 300 shows generally a vertical directional response, by frequency, of acoustic output from the first woofer 302 and the second woofer 304 when they are used together.

Different response characteristics than those illustrated would be expected if only one driver is used or if greater than two drivers is used.

The first woofer 302 and the second woofer 304 have respective central axes that can be perpendicular to a plane of the woofer baffle 206. The central axes of the woofers are spaced apart by a first distance or woofer spacing 316. The length of the woofer spacing 316 can influence or affect a polar response of the system. For example, a vertical dispersion of the system can be influenced by the woofer spacing 316. The woofer spacing and polar response can be tuned or selected, for example, based on one or more characteristics of a horn section that can be provided adjacent to the woofers.

The example of FIG. 3 shows a polar plot 306 corresponding to a first woofer spacing 316. The vertical polar plot 306 indicates, by frequency, a relative vertical response of the system at various locations that are off-axis to the system that includes both illustrated woofers. The polar plot 306 includes a 6 dB down line 314 that indicates, for each of multiple frequencies, where the acoustic output of the system is attenuated by 6 dB relative to a reference position or normalized position, such as relative to a location that would be directly on-axis with the woofer portion of the system. In the illustrated example, the reference position or normalized position corresponds to 90 degrees in the polar plot 306. In the illustrated example, a central lobe 308 of the polar plot 306 extends coaxially with the reference direction. At about 1800 Hz, the cutoff or intersection with the 6 dB down line 314 is at about 70 degrees and 110 degrees (e.g., about a 40 degree vertical spread). If the woofer spacing 316 is increased, then the cutoff or intersection with the 6 dB down line 314 would be at different angles, for example indicating narrower dispersion and a relatively more focused central lobe 308. The example polar plot 306 of FIG. 3 illustrates an upper side lobe 312 and a lower side lobe 310. The side lobes, which are generally to be minimized, indicate generally vertical off-axis performance of the system relative to the reference or central axis of the system.

In the example of FIG. 3, the first woofer 302 and second woofer 304 are mounted such that sound projecting faces of the woofers are provided in the same plane. In other examples, the woofers can be splayed or angled relative to one another, or can be offset in the horizontal or vertical directions.

Figure 4:
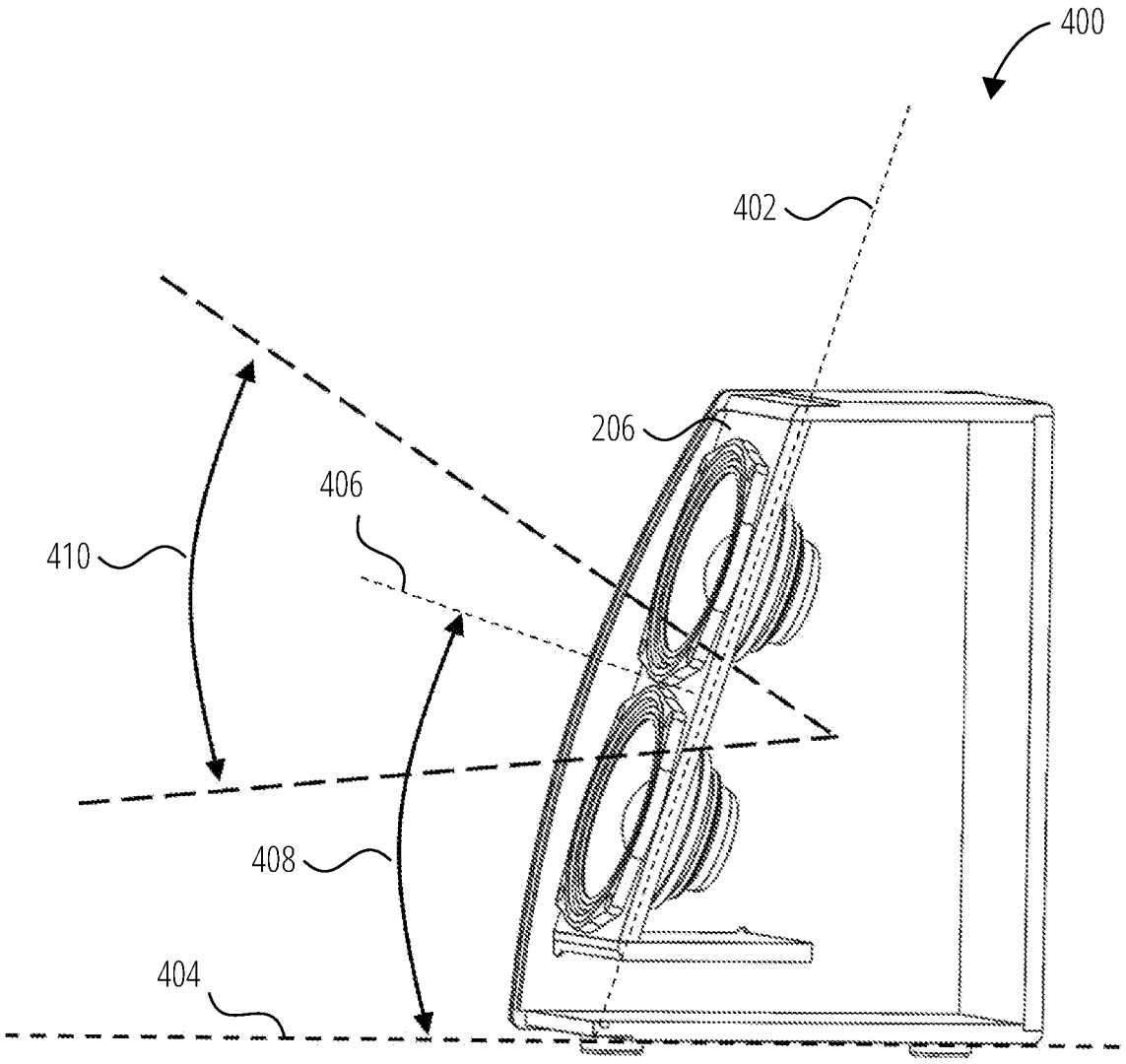
FIG. 4 illustrates a cabinet detail in accordance with one example.

FIG. 4 illustrates generally an example of a cabinet detail 400 for the woofer and high frequency cabinet 204, particularly for the first woofer 302, the second woofer 304, and the woofer baffle 206. The cabinet detail 400 includes the woofer and high frequency cabinet 204 and a horizontal plane 404. The horizontal plane 404 can be parallel to a bottom surface of the woofer and high frequency cabinet 204 and, in an example, the horizontal plane 404 provides a reference for various other features of the woofer and high frequency cabinet 204.

In an example, the woofer baffle 206 has a baffle plane 402. The baffle plane 402 can include a plane or surface to which the first woofer 302 and the second woofer 304 are mounted. The baffle plane 402 can be offset from a vertical axis or vertical plane and from the horizontal plane 404. Instead, the baffle plane 402 can be angled such that acoustic information from woofers mounted to the woofer baffle 206 can be directed at least partially upward and away from the horizontal plane 404. In an example, a bottom edge (e.g., −6 dB point) of the subtended angle, or woofer vertical angle 410, can be parallel to, but offset from, the horizontal plane 404.

The woofer baffle 206 can have a baffle center axis 406. The baffle center axis 406 can be a central axis of the woofer baffle 206 and can be located at a midpoint between axes of the first woofer 302 and the second woofer 304 on the baffle plane 402. In an example, an orientation of the baffle plane 402 can be defined in part by a baffle angle 408, such as can include an angle between the baffle center axis 406 and the horizontal plane 404. In an example, the baffle angle 408 can be greater than about 10 degrees and less than about 30 degrees. In an example, the baffle angle 408 can be between about 15 degrees and 20 degrees.

As described above in the discussion of FIG. 3, the woofer and high frequency cabinet 204 has an acoustic output that can be defined or measured at least in part using polar response information. Spacing between the woofers in the woofer and high frequency cabinet 204, such as additionally to other signal phase correction, and characteristics of the woofer baffle 206 can influence the response. In the example of FIG. 4, a woofer vertical angle 410 indicates generally a response in the vertical plane from the woofers, such as over a particular range of frequencies. The response of the woofers alone is generally not a constant directivity response, for example, because there can be relatively little reinforcement of higher frequency information, especially off-axis or away from the baffle center axis 406. Additionally, woofer response patterns generally drop off at relatively higher frequencies due to the mass-controlled region of the woofer. However, by introducing a horn section that includes a waveguide, an overall system response and directivity can be enhanced. In an example, directivity characteristics of acoustic output from the woofers mounted to the woofer baffle 206 can be configured to substantially match directivity characteristics of acoustic output from the horn section at one or more crossover frequencies.

Figure 5:
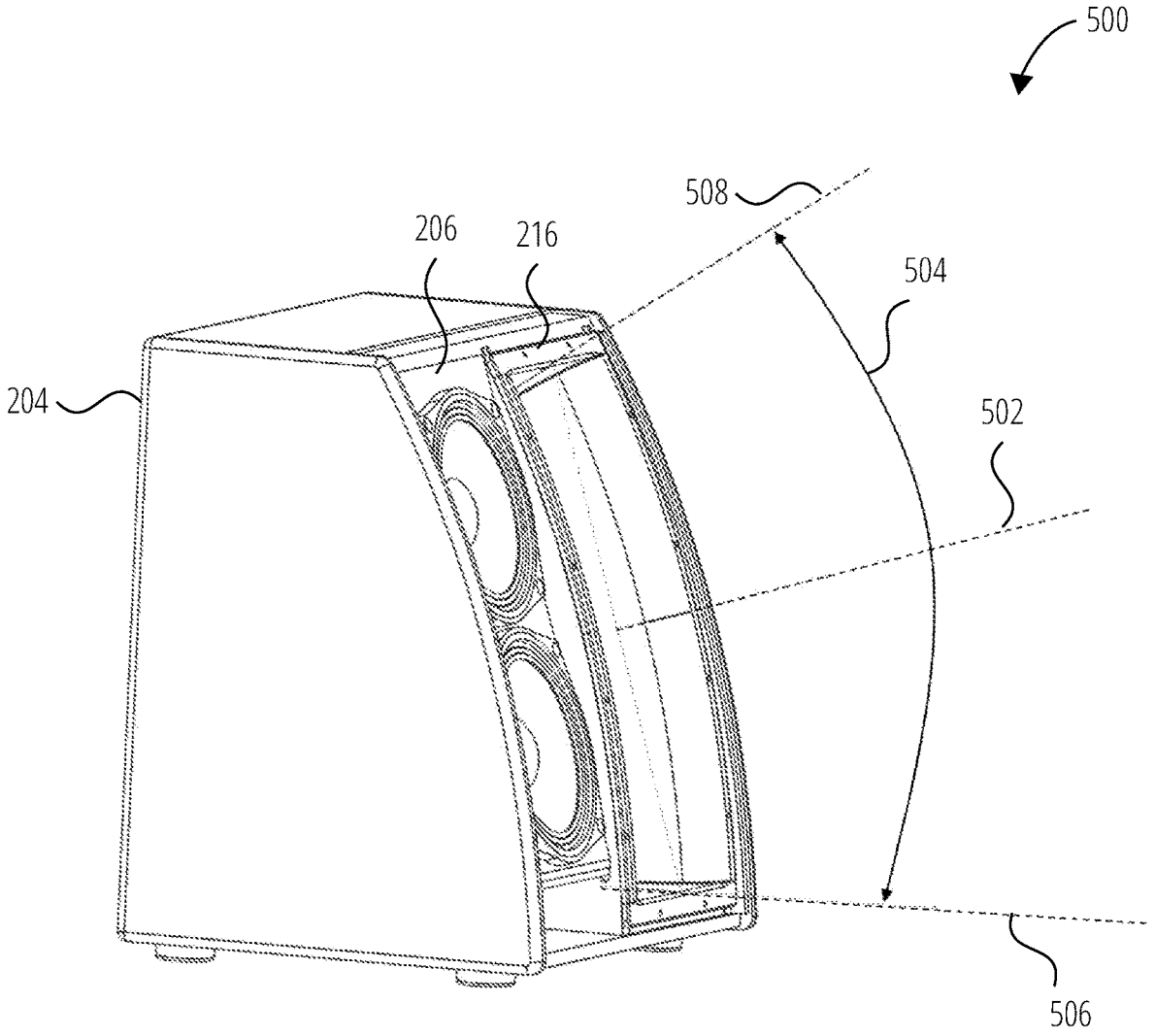
FIG. 5 illustrates a waveguide detail in accordance with one example.

FIG. 5 illustrates generally an example of the woofer and high frequency cabinet 204 including the waveguide 216. The example of FIG. 5 includes the woofer baffle 206 to illustrate generally an example of a relationship or relative position of the waveguide 216 and the woofer baffle 206 when the waveguide 216 and woofer baffle 206 are provided adjacent to each other. FIG. 5 includes a waveguide reference plane 506 that is defined by the orientation of the waveguide 216. In an example, the waveguide reference plane 506 is parallel to, but offset vertically from, the horizontal plane 404 of the woofer and high frequency cabinet 204. In other examples, the waveguide reference plane 506 can be angled or offset from a horizontal reference plane such as by 10 degrees or less, or can have other offsets or orientations.

The waveguide 216 can have various dimensions and acoustic shaping characteristics. In an example, the waveguide 216 has a waveguide top plane 508 corresponding to an uppermost sound-projecting edge or face of the waveguide 216. The waveguide 216 can include a waveguide center axis 502 provided at or about halfway between the waveguide reference plane 506 and the waveguide top plane 508. A waveguide vertical angle 504 indicates a vertical splay of the top and bottom edges of the waveguide 216. In an example, the waveguide vertical angle 504 is about 40 degrees. The vertical angle 504 generally indicates a vertical acoustic dispersion pattern of the horn.

In an example, the waveguide center axis 502 can be parallel to, or can be co-planar with, the baffle center axis 406. In other words, a center axis of the waveguide 216 and a center axis of the woofer baffle 206 can be parallel. Other relationships between the waveguide center axis 502 and baffle center axis 406 can be used to affect a relationship between a polar response of the woofer and high frequency portion 102 of the loudspeaker system 100.

Figure 6:
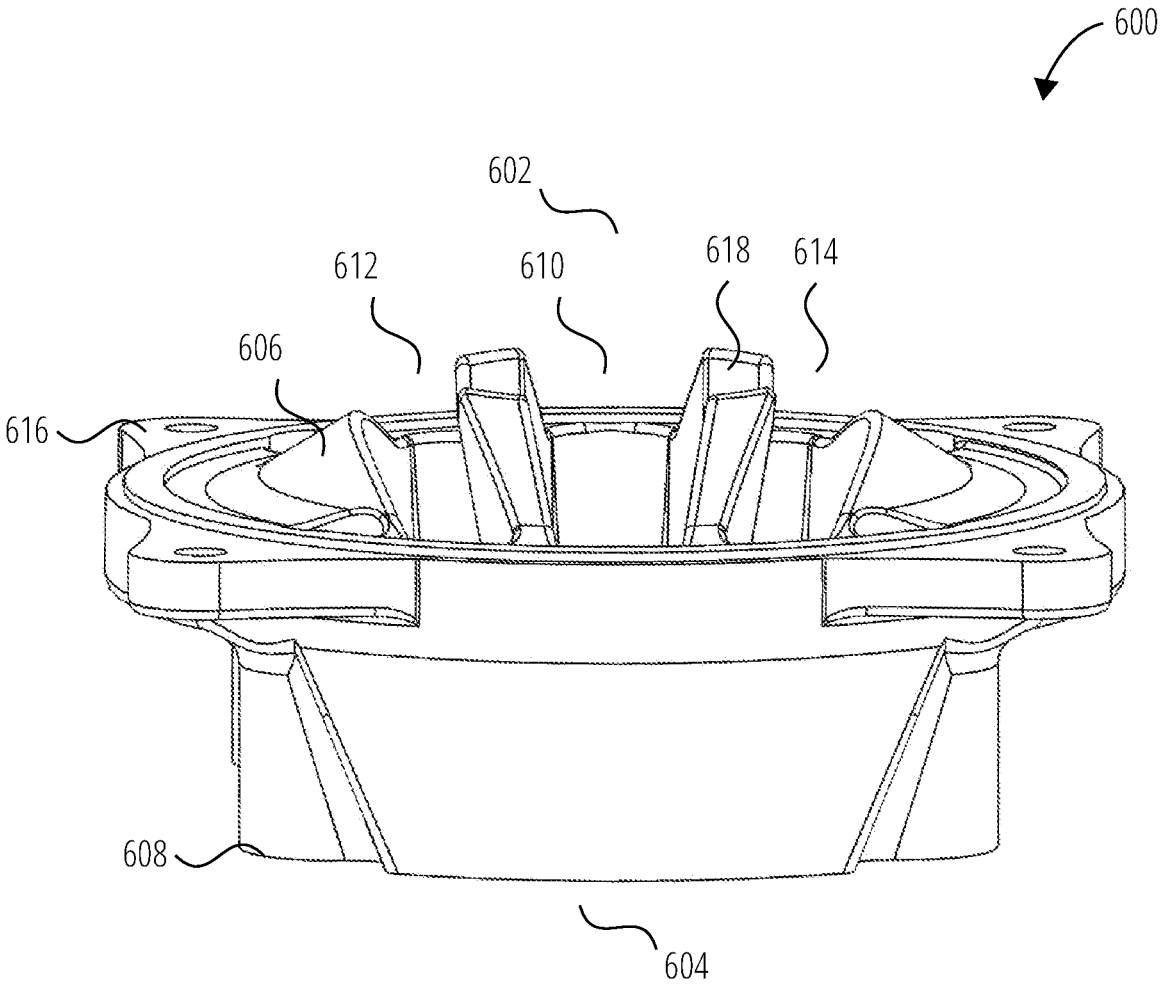
FIG. 6 illustrates a lens in accordance with one example.

FIG. 6 illustrates generally a perspective view of a first example of an acoustic lens 600. The lens 600 can comprise one or more of the lenses 214 from the example of FIG. 2. In an example, the lens 600 can be configured to promote coherence of acoustic information from a source transducer, such as from one of the full-range woofer drivers 212, at a throat or outlet of a horn section or of the waveguide 216.

The lens 600 comprises a lens inlet side 602 that can be coupled to a source or transducer, such as a cone-shaped woofer transducer. The lens 600 can be coupled to the transducer using, for example, a driver interface 616. The lens 600 comprises a lens outlet side 604 that can be coupled to a waveguide, such as the waveguide 216, or other controlled-directivity output device. The lens 600 can be coupled to the waveguide 216 using a waveguide interface 608. The lens 600 includes various features that can promote a tailored frequency response, such as for coherence of acoustic information at an output of the loudspeaker system 100.

In an example, to extend high frequency performance of a theoretically ideal loudspeaker with a diaphragm that vibrates uniformly as one piston at all frequencies, the lens 600 can be closely spaced to a loudspeaker diaphragm. A distance between one or more through-holes or passages in the lens 600 can be minimized, and sound travel path lengths through the lens 600 can be substantially equal. In practice, however, different portions of a source loudspeaker diaphragm can vibrate at different frequencies. For example, at relatively higher frequencies, a dust cap or dome portion of a cone loudspeaker driver adjacent to the voice coil can vibrate uniformly while other peripheral portions of the same loudspeaker's diaphragm may be in vibration anti-phase with still other portions of the cone, thereby resulting in a bulk cancellation. To help ensure higher frequency acoustic signals are efficiently released from a loudspeaker system, the lens 600 can be configured to allow acoustic information originating from a dust cap or dome portion to pass, such as into a waveguide, without being physically impeded by a portion of the lens 600.

The lens 600 can have various dimensions or characteristics. In an example, the lens 600 can have surface features or contours that match or mirror surface features or contours of the loudspeaker transducer diaphragm with which the lens 600 is used. For example, a convexity or concavity of the lens 600 can be configured to substantially match a concavity or convexity of a corresponding diaphragm cone. For the purposes of this discussion, a "matched" concavity and convexity can be opposite or opposing surfaces having the same or substantially the same angles, curves, dimensions, or other characteristics. In the example of FIG. 6, the lens 600 includes at least a peripheral inlet contour 606 that can have a slope that is configured to be substantially the same as a slope of a cone diaphragm of a transducer that is mounted to the lens inlet side 602 of the lens 600. The lens 600 can include a central inlet contour 618 that is configured to be substantially the same as a contour or feature of a dust dome or cap of a transducer that is mounted to the lens inlet side 602 of the lens 600.

In an example, one or more passages or through holes can be provided in the lens 600 such that acoustic energy from a transducer mounted to the lens 600 can be directed through the lens 600 and, for example, into the waveguide 216. The one or more passages can have various sizes and shapes. In some examples, the one or more passages can be slot-shaped, ring-shaped, star-shaped, or otherwise shaped. In an example, the lens 600 can include slots having various configurations such as including a concentric ring formation, a perforated formation, or a slot formation wherein one or more of the slots or the sidewalls thereof can be wedge-shaped.

In the example of FIG. 6, the lens 600 includes a central passage 610, a first peripheral passage 612, and a second peripheral passage 614. In an example, at least one passage can be provided coaxially with the transducer that drives the lens 600 such that acoustic information from a central dust cap or dome portion of the transducer can be directly communicated to the waveguide 216. In other words, the central passage 610 can be configured such that it provides an open area or through hole for communication of acoustic information from a transducer to a waveguide. Although the example of the lens 600 includes three slots, fewer or additional slots or passages can similarly be used.

In an example, at least one passage through the lens can be provided substantially coaxially with the transducer that drives the lens 600 such that acoustic information from a central dust cap or dome portion of the transducer can be communicated to the waveguide 216. In other words, the central passage 610 can be configured such that it provides an open area or through hole for communication of acoustic information from the vicinity of the dust cap or dome portion of the transducer to a waveguide or other outlet. The passage can optionally be laterally offset from the central axis of the transducer. Generally, however, at least a portion of the passage can be configured to receive acoustic energy from a least a portion of the dust cap or dome of the transducer such that high frequency information originating from or near the central axis of the transducer can be received and communicated directly to the outlet of the lens or to a waveguide.

Figure 7:
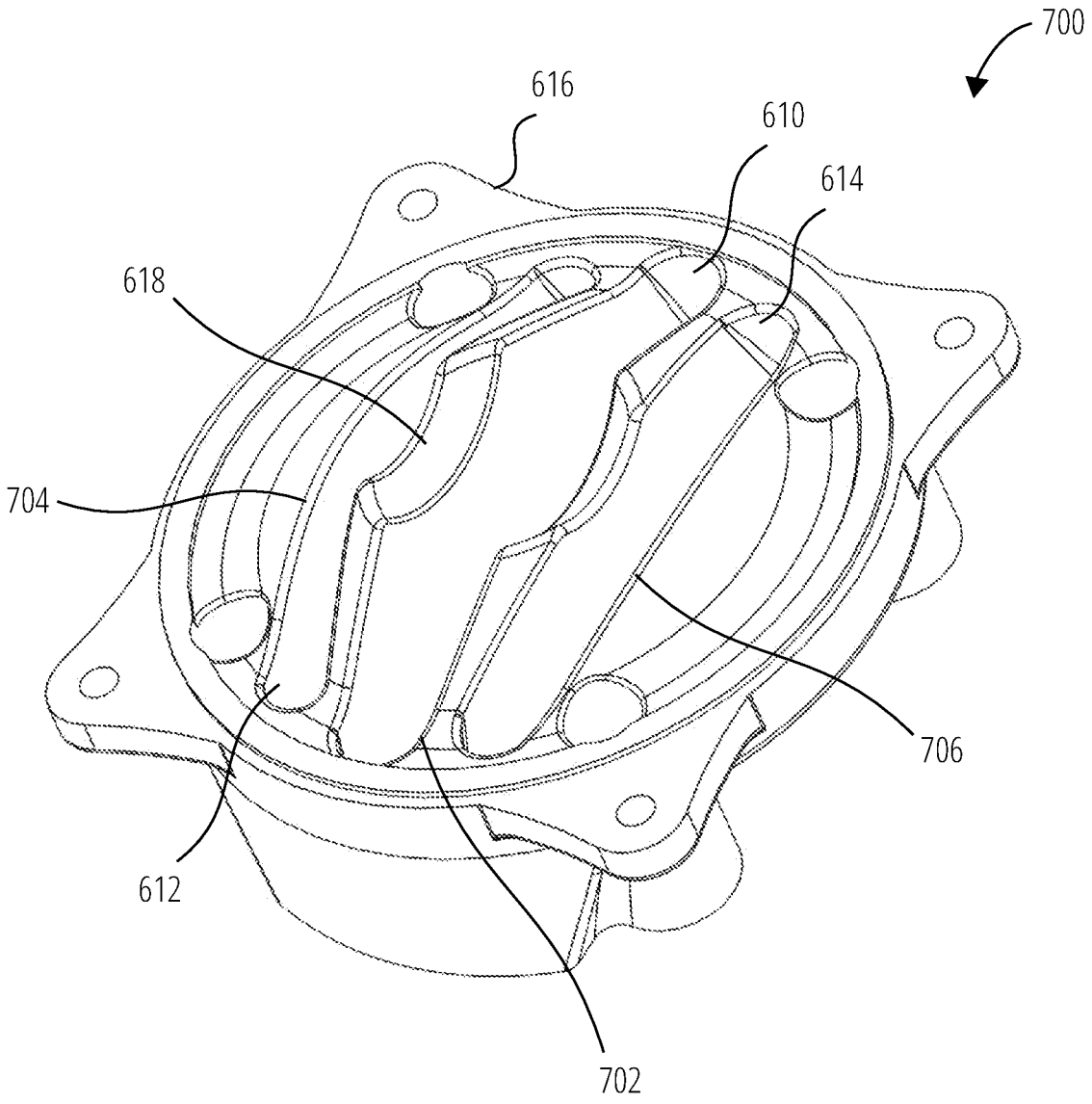
FIG. 7 illustrates an inlet side perspective view in accordance with one example of a lens.

FIG. 7 illustrates generally an inlet side perspective view 700 of the lens 600. The example of FIG. 7 shows, from another vantage point, the various contours and surfaces of the lens 600. For example, FIG. 7 illustrates a concavity of the central inlet contour 618, such as can be configured to match or mirror a convex surface of a dust dome or cap of a transducer.

The example of FIG. 7 illustrates that each of the slots or passages in the lens 600 is an elongate or extended oval-shaped slot and each slot has a respective aperture characteristic on the lens inlet side 602. For example, the central passage 610 has a corresponding central inlet aperture 702. The central inlet aperture 702 can include a perimeter or edge portion of the central passage 610 or of the central slot of the lens 600. The central inlet aperture 702 can have a length characteristic and can define an area of the opening of the central inlet aperture 702.

Similarly, the first peripheral passage 612 can have a corresponding first peripheral inlet aperture 704, and the second peripheral passage 614 can have a corresponding second peripheral inlet aperture 706. In an example, the peripheral passages can be substantially slot shaped or can be kinked or angled, such as having a kidney bean-type shape. One or more of the apertures can have the same or different characteristics. For example, a length or area characteristic of the central inlet aperture 702 can be greater than corresponding length or area characteristics of the first peripheral inlet aperture 704 or the second peripheral inlet aperture 706, or vice versa. In other words, a size of the inlet to the central passage 610 of the lens 600 can be larger than the respective sizes of the inlets to the first peripheral passage 612 or second peripheral passage 614. In other examples, a size of the inlet to the central passage 610 can be smaller than the sizes of the other passage inlets.

Figure 8:
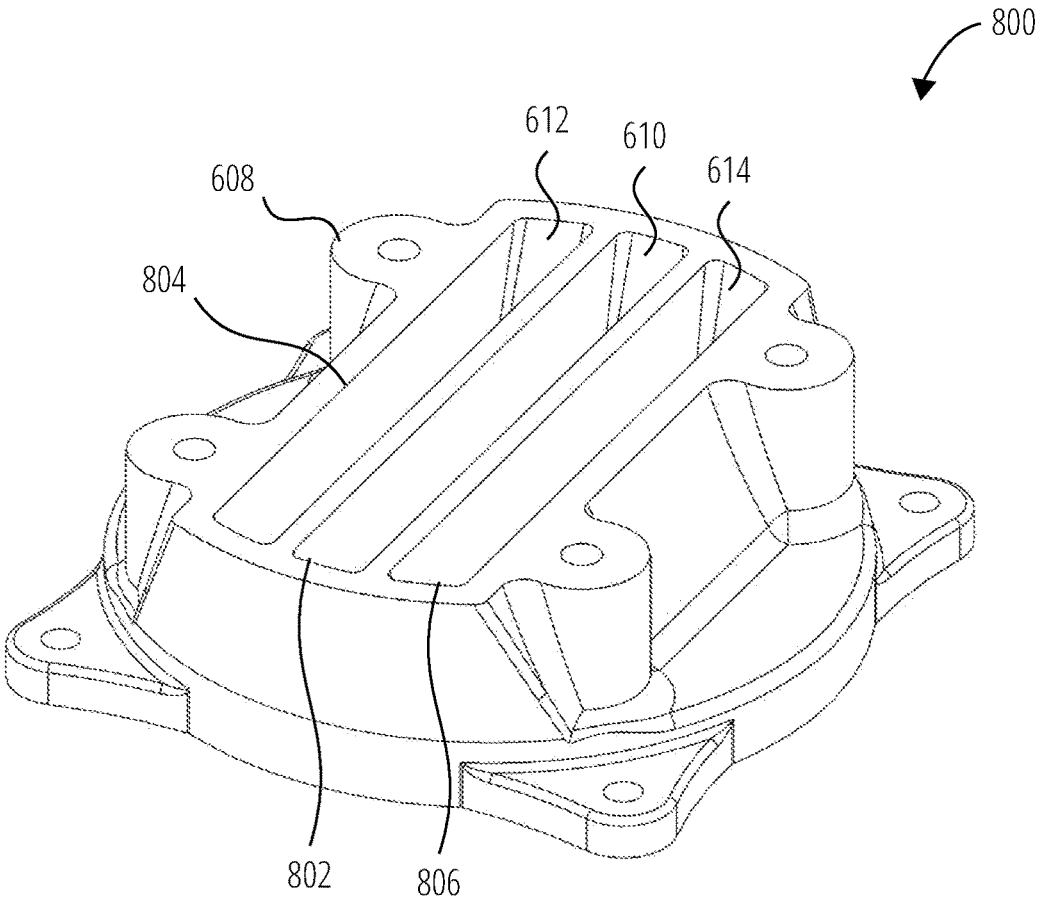
FIG. 8 illustrates an outlet side perspective view in accordance with one example of a lens.

FIG. 8 illustrates generally an outlet side perspective view 800 of the lens 600. The example of FIG. 8 shows various details of the lens outlet side 604 of the lens 600, such as can be communicatively coupled with an inlet of the waveguide 216. The lens outlet side 604 can include or can be coupled to portions of the central passage 610, the first peripheral passage 612, and the second peripheral passage 614.

The example of FIG. 8 illustrates that each of the slots or passages in the lens 600 has a respective aperture characteristic on the lens outlet side 604. For example, the central passage 610 has a corresponding central outlet aperture 802. The central outlet aperture 802 can include a length or perimeter edge portion of the central passage 610 or central slot of the lens 600. The central outlet aperture 802 can have a length characteristic and can define an area of the opening of the central outlet aperture 802. Similarly, the first peripheral passage 612 can have a corresponding first peripheral outlet aperture 804, and the second peripheral passage 614 can have a corresponding second peripheral outlet aperture 806. One or more of the apertures can have the same or different characteristics. For example, a length or area characteristic of the central outlet aperture 802 can be greater than corresponding lengths or area characteristics of the first peripheral outlet aperture 804 or the second peripheral outlet aperture 806. In other words, a size of the outlet from the central passage 610 of the lens 600 can be larger than the respective sizes of the outlets from the first peripheral passage 612 or the second peripheral passage 614. In other examples, a size of the outlet from the central passage 610 of the lens 600 can be smaller than the respective sizes of the outlets from the peripheral passages.

Figure 9:
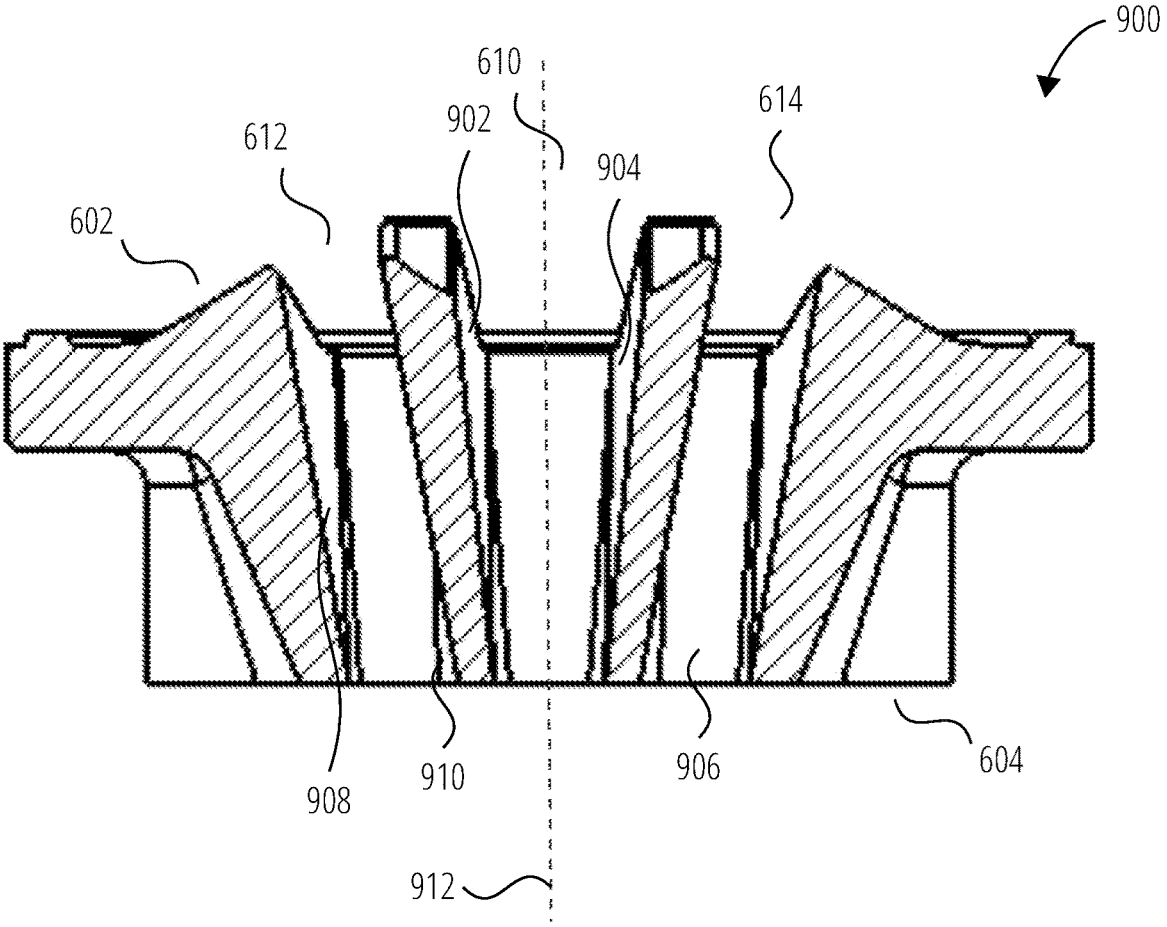
FIG. 9 illustrates a cross section view in accordance with one embodiment of a lens.

FIG. 9 illustrates generally an example of a cross section view 900 of the acoustic lens 600. In the example of FIG. 9, the cross section view 900 shows relationships between features or characteristics of the lens inlet side 602 and features or characteristics of the lens outlet side 604 of the lens 600.

FIG. 9 illustrates a lens central axis 912 that extends centrally through the lens 600, such as through the central passage 610 of the lens 600. In an example, the central passage 610 includes or is defined in part by sidewalls, such as a first central sidewall 902 and a second central side wall 904. The first central sidewall 902 can be angled, such as relative to the lens central axis 912, such that the first central sidewall 902 would converge with or contact the lens central axis 912 if it were lengthened. In other words, the first central sidewall 902 can be sloped relative to the axis of the lens 600. The opposite second central side wall 904 can be similarly sloped relative to the lens central axis 912 such that the second central side wall 904 and first central sidewall 902 have one or more portions that are nearer to the lens central axis 912 at the lens outlet side 604 than at the lens inlet side 602. Stated differently, due to a sloped and converging nature of the first central sidewall 902 and second central side wall 904, the length of an aperture at the lens inlet side 602 of the central passage 610 can be greater than a length of an aperture at the lens outlet side 604 of the same central passage 610. In other words, the first central sidewall 902 and second central side wall 904 can provide a pair of walls for a tapered central passage 610.

In the example of FIG. 9, the first peripheral passage 612 comprises a first peripheral sidewall 908 and a second peripheral sidewall 910. In an example, the first peripheral sidewall 908 and the second peripheral sidewall 910 can be sloped such that a length of an aperture of at the lens inlet side 602 of the first peripheral passage 612 can be greater than a length of an aperture at the lens outlet side 604 of the same first peripheral passage 612.

Stated differently, each of various passages or through-holes in the lens 600 can be funnel-shaped such that each passage has a greater surface area characteristic at its inlet side than at its outlet side. That is, the central passage 610 can be funnel-shaped with a smaller or converging end at the lens outlet side 604, the first peripheral passage 612 can be similarly funnel-shaped with a smaller or converging end at the lens outlet side 604, and the second peripheral passage 614 can be similarly funnel-shaped with a smaller or converging end at the lens outlet side 604. By using the various passages of the lens 600 to adjust acoustic throughput of the lens 600, a magnitude of acoustic signals at the output, or at the lens outlet side 604, can have a sufficient magnitude to ensure the waveguide 216 can restrain the output pattern or response. In other words, the shapes of the various passages in the lens 600 can be configured to ensure the high frequency section has or exhibits specified directivity characteristics during use.

Figure 10:
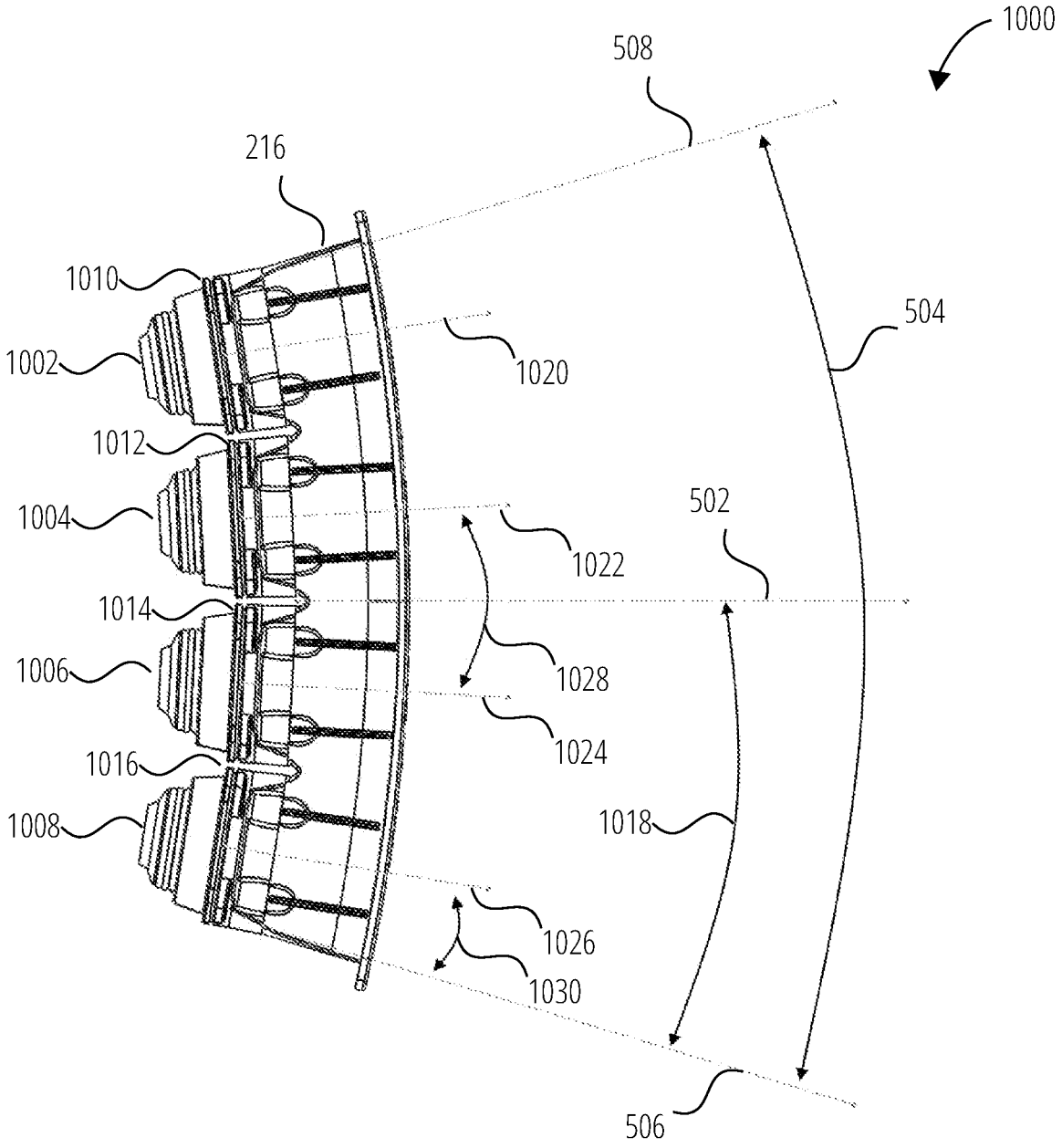
FIG. 10 illustrates a horn section in accordance with one example.

In an example, the lens 600 can be coupled to a waveguide, such as the waveguide 216 from the example of FIG. 2, and to a driver. FIG. 10 illustrates generally an example of a horn section 1000 that can include the waveguide 216 coupled to multiple different instances of the lens 600 that, in turn, are coupled to respective multiple different loudspeaker drivers. In other words, the side view example of the horn section 1000 in FIG. 10 illustrates an assembly that can include the full range woofer drivers 212, the lenses 214, and the waveguide 216 from the example of FIG. 2.

The example of FIG. 10 includes multiple woofer drivers coupled to respective different lenses. For example, a first driver 1002 can be coupled to a first lens 1010, a second driver 1004 can be coupled to a second lens 1012, a third driver 1006 can be coupled to a third lens 1014, and a fourth driver 1008 can be coupled to a fourth lens 1016. Additional or fewer lenses and drivers can similarly be used. The various lenses 1010-1016 can be coupled to an inlet of the waveguide 216.

In an example, the waveguide 216 has a vertical splay angle, or waveguide vertical angle 504, that can extend from the waveguide reference plane 506 (e.g., corresponding to the horizontal plane 404 in some examples) to the waveguide top plane 508. In an example, the waveguide vertical angle 504 can be greater than about 30 degrees and less than about 50 degrees. The waveguide center axis 502 can be provided midway between the waveguide reference plane 506 and the waveguide top plane 508. The waveguide 216 thus includes a splayed or angled acoustic outlet. The various drivers 1002-1008 can be splayed or angled in a corresponding manner. That is, inlet portions of the waveguide 216 corresponding to each of the drivers can be differently angled such that sound-projecting faces of the drivers are arranged along an arcuate path. The arcuate path along which the drivers are arranged can be the same or similar to a vertical angle of the waveguide 216.

For example, the first driver 1002 can have a first driver central axis 1020, such as can be angled relative to, or non-parallel to, the waveguide top plane 508. The second driver 1004 can have a second driver central axis 1022, such as can be angled relative to, or non-parallel to the first driver central axis 1020 and to the waveguide top plane 508. Similarly, the third driver 1006 can have a third driver central axis 1024 that can be differently angled, and the fourth driver 1008 can have a fourth driver central axis 1026 that can be further differently angled. In an example, the fourth driver central axis 1026 can be offset from the waveguide reference plane 506 by a reference-driver axis angle 1030. The reference-driver axis angle 1030 can, in an example, be about 5-10 degrees. In an example, the second driver central axis 1022 and the third driver central axis 1024 can be offset such that a first inter-driver axis angle 1028 is about 5-10 degrees. In an example, the first inter-driver axis angle 1028 can be greater than the reference-driver axis angle 1030, or vice versa. A waveguide vertical half-angle 1018, such as from the waveguide reference plane 506 to the waveguide center axis 502, can be at least about 15 degrees and less than about 25 degrees.

Figure 11:
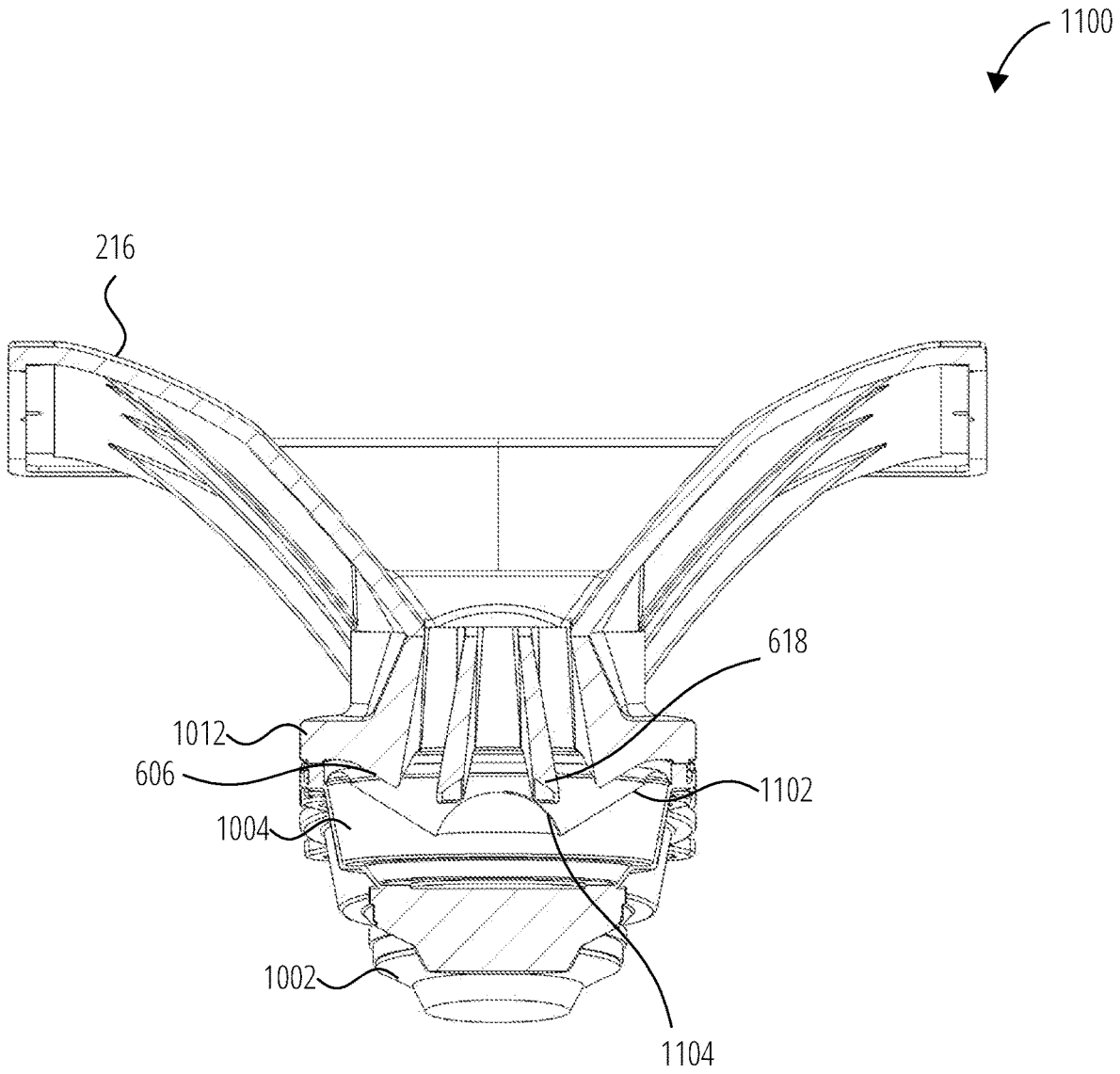
FIG. 11 illustrates a partial cross-section view of a horn section in accordance with one example.

FIG. 11 illustrates generally a partial cross-section view 1100 of the horn section 1000. The partial cross-section view 1100 shows the peripheral inlet contour 606 and the central inlet contour 618 of the lens 600, the first driver 1002, the second lens 1012, the second driver 1004, the waveguide 216, a cone diaphragm 1102 of the second driver 1004, and a dust dome 1104 of the second driver 1004.

The example of FIG. 11 illustrates generally the matched or mirrored relationship between the central inlet contour 618 and a contour of the dust dome 1104. That is, the dust dome 1104 follows a curved path and the central inlet contour 618 follows substantially the same curved path but offset from and spaced apart from the dust dome 1104 itself. Similarly, the cone diaphragm 1102 follows a sloped path and the peripheral inlet contour 606 follows substantially the same slope but is offset from and spaced apart from the cone diaphragm 1102.

FIG. 11 illustrates a cross section of the second lens 1012, such as corresponding to the cross section view 900 of the lens 600 from the example of FIG. 6. The second lens 1012 includes various funnel-shaped passages or slots that receive information from the second driver 1004 and transmit the information into a body of the waveguide 216. That is, inlet surface areas, or apertures, of the slots in the second lens 1012 can be large relative to the respective outlet surface areas for the same slots.

Variations of any one or more of the cabinets, transducers, waveguides, lenses, baffles, orientations, angles, or other components or features of the loudspeaker system 100 can similarly be used to provide a substantially full-range loudspeaker system configured to provide controlled or constant directivity. FIGS. 12-20 illustrate generally examples of different lens configurations that can be used, alone or in combination with each other. In an example, any one or more of the lenses, or lens features, illustrated in FIGS. 12-20 can be used with or used in place of the various examples of the lens 600 discussed elsewhere herein. For example, one or more instances of a second lens (e.g., FIGS. 12-14), or one or more instances of a third lens (e.g., FIGS. 15-17), or one or more instances of a fourth lens (e.g., FIGS. 18-20), or aspects thereof, can be used additionally or alternatively to the examples illustrated elsewhere herein that incorporate the first lens 600.

Figure 12:
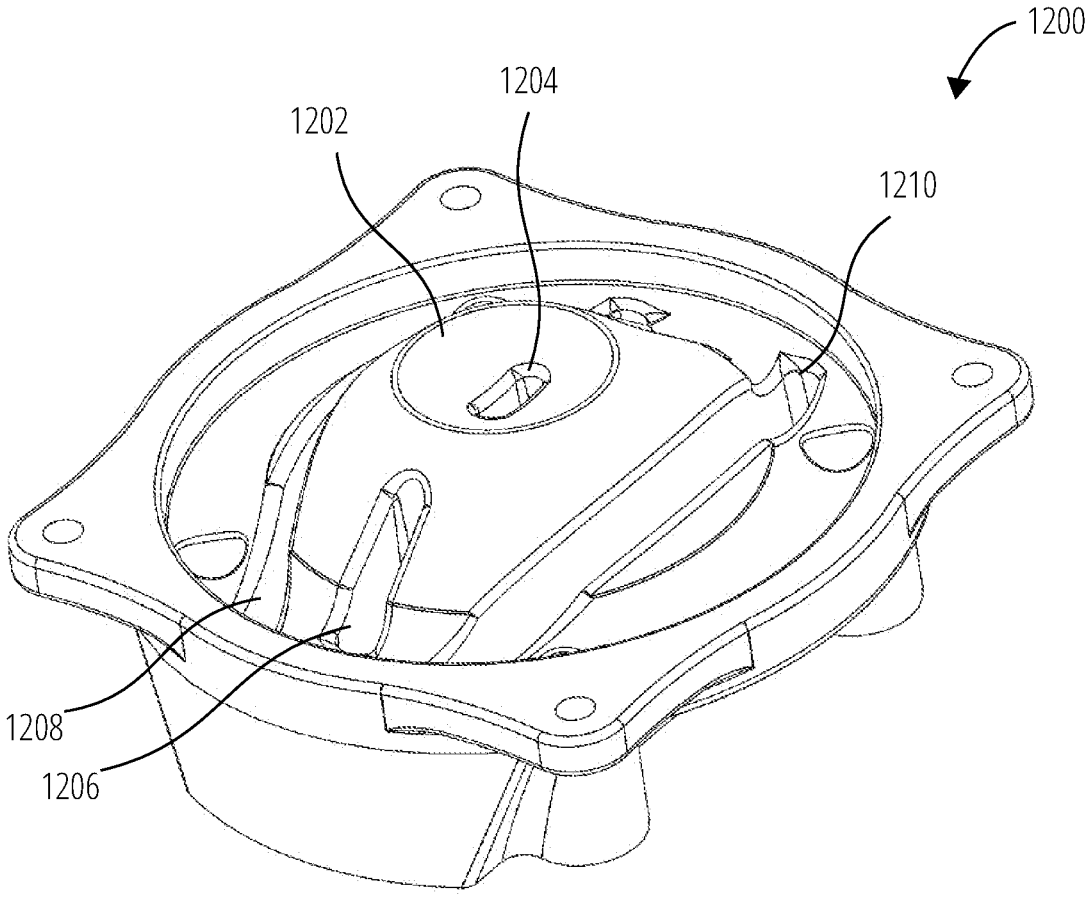
FIGS. 12-14 illustrate generally various views of an example of a second lens.

FIG. 12 illustrates generally a perspective inlet-side view of an example of a second lens. The example of FIG. 12 includes a second lens inlet side 1200 that includes an inlet dome contour 1202, a second lens axial passage 1204, a central first peripheral passage 1206, a first peripheral side passage 1208, and a second peripheral side passage 1210. A central second peripheral passage 1302 (see FIG. 13) can be included, however, it is obscured from view in the illustration of FIG. 12.

Any one or more of the passages in the second lens can have one or more sidewalls that can be planar or curved. In an example, one or more of the sidewalls can be parallel to a plane of the central axis of a lens, or one or more of the sidewalls can be angled or tapered, such as similarly discussed above in the example of the lens 600, such that the one or more passages can be funnel-shaped. The various passages are configured to facilitate acoustic communication between a transducer that is coupled to a first side of the second lens and a waveguide such as can be coupled to an opposite second side of the second lens.

Figure 13:
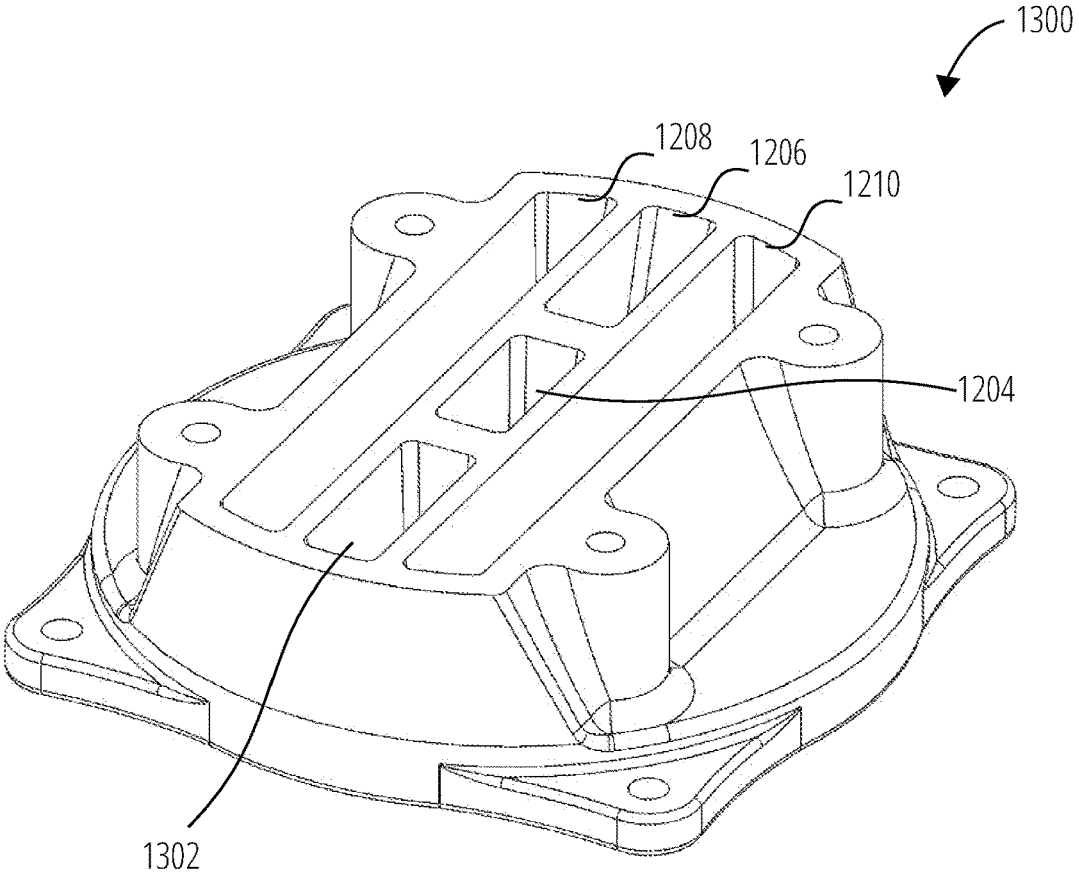

FIG. 13 illustrates generally a perspective outlet-side view of the second lens. The second lens outlet side 1300 comprises the second lens axial passage 1204, the central first peripheral passage 1206, the first peripheral side passage 1208, the second peripheral side passage 1210, and the central second peripheral passage 1302. In an example, one or more of the passages can be acoustically coupled within the thickness direction of the lens. That is, one or more through-holes can be provided between two or more adjacent passages.

Figure 14:
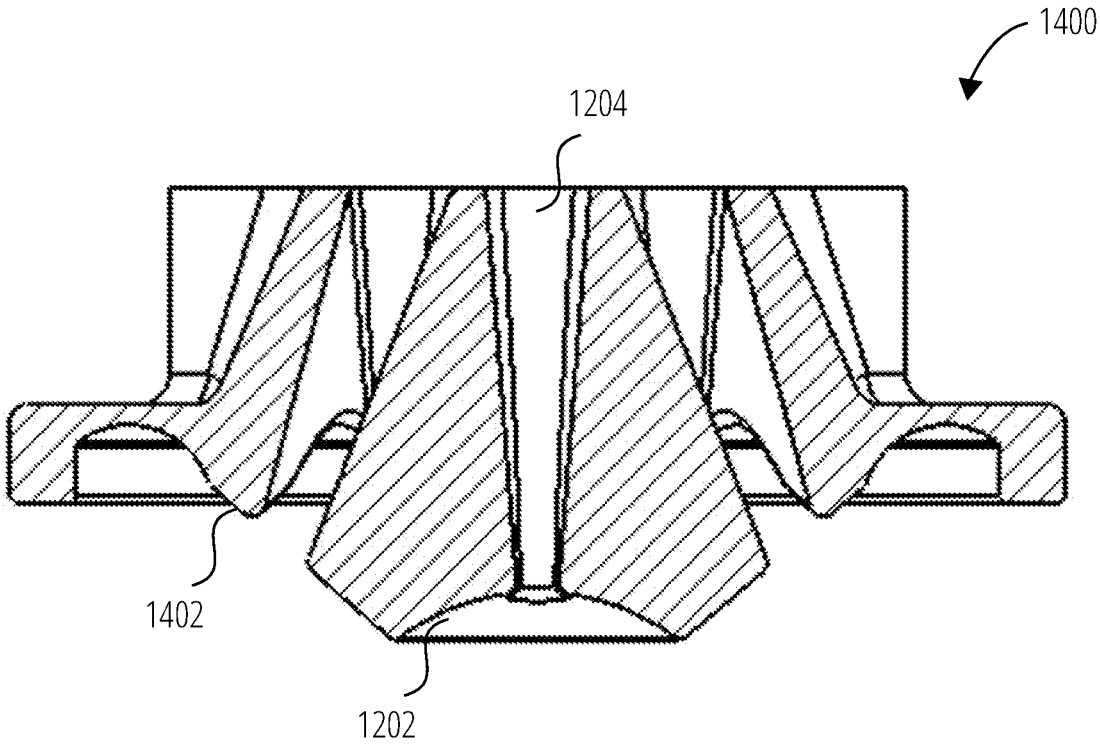

FIG. 14 illustrates generally a second lens cross section view 1400 for the second lens. The example of FIG. 14 includes the inlet dome contour 1202, the second lens axial passage 1204, and an inlet cone contour 1402. From the second lens cross section view 1400, it can be observed that one or more of the passages is funnel-shaped or tapered and includes a relatively smaller inlet-side cross sectional area than an outlet-side cross sectional area for the same passage.

In an example, the various communication paths through a lens can have various shapes, sizes, divisions, and contours. In the example of the second lens, such as illustrated in FIGS. 12-14, a central portion of the lens can be divided into multiple different passages, and multiple other, larger passages can be provided at the periphery. In the examples of FIGS. 12-14, the second lens axial passage 1204 can be centered over an adjacent woofer's dust cap or dome. Areas of the lens surface adjacent to the second lens axial passage 1204 can have an inlet dome contour 1202 that can be conical or spherical, such as to match a dust dome shape in a mirrored manner. In an example, an aperture of the second lens axial passage 1204 can be made sufficiently small enough to diffract high frequency wave fronts or high frequency acoustic information received from the adjacent transducer, such as to thereby better supply a waveguide coupled to the outlet of the second lens. In the example of the second lens, the central first peripheral passage 1206 and the central second peripheral passage 1302 can receive information from a cone surface of the transducer and, acoustic energy received through these slots can also contribute to a high frequency response of the system.

Figure 15:
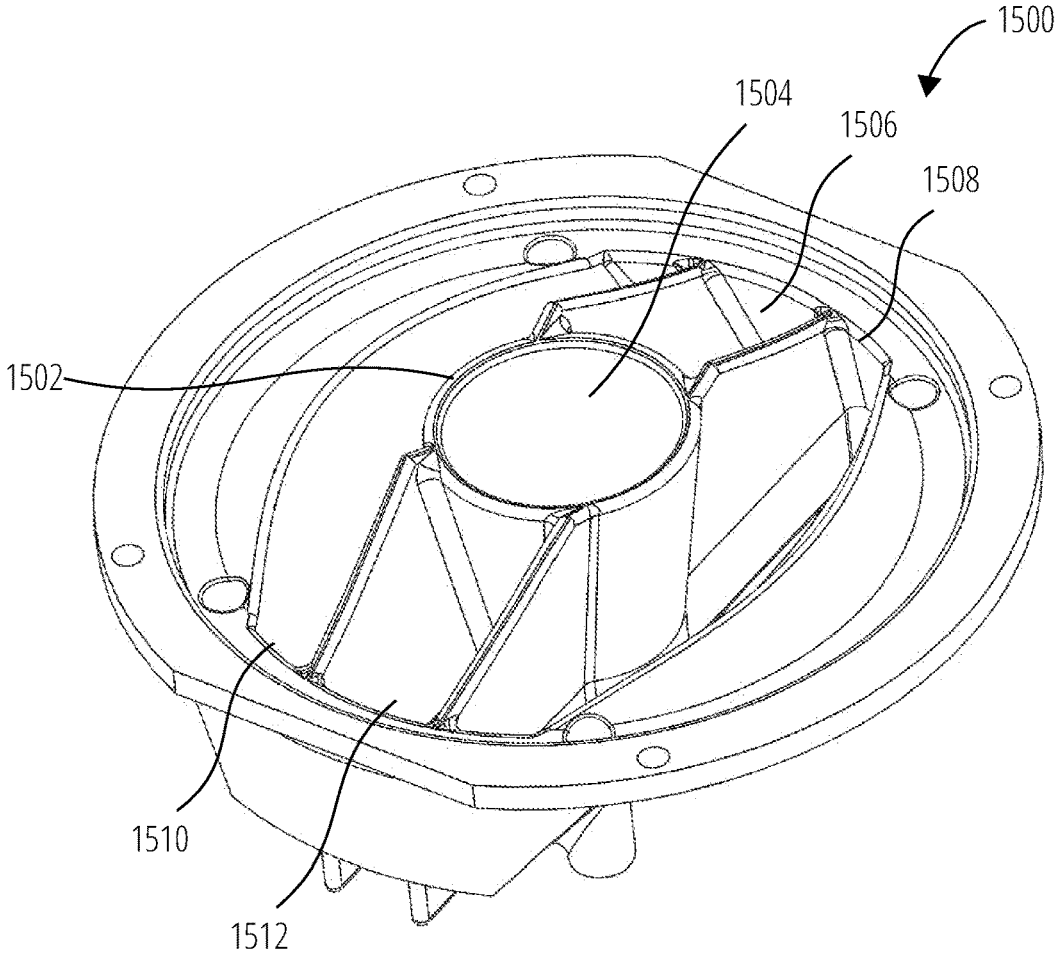
FIGS. 15-17 illustrate generally various views of an example of a third lens.

FIG. 15 illustrates generally a perspective inlet-side view of an example of a third lens. The example of FIG. 15 includes a third lens inlet side 1500 that includes a dome receiving portion 1502, a third lens axial passage 1504, a central first peripheral passage 1506, a first peripheral side passage 1508, a second peripheral side passage 1510, and a central second peripheral passage 1512. Any one or more of the passages in the third lens can have straight or angled or tapered sidewalls, as similarly discussed for the other lens examples herein. The various passages facilitate acoustic communication between a transducer that is coupled to a first side of the third lens and a waveguide such as can be coupled to an opposite second side of the third lens.

Figure 16:
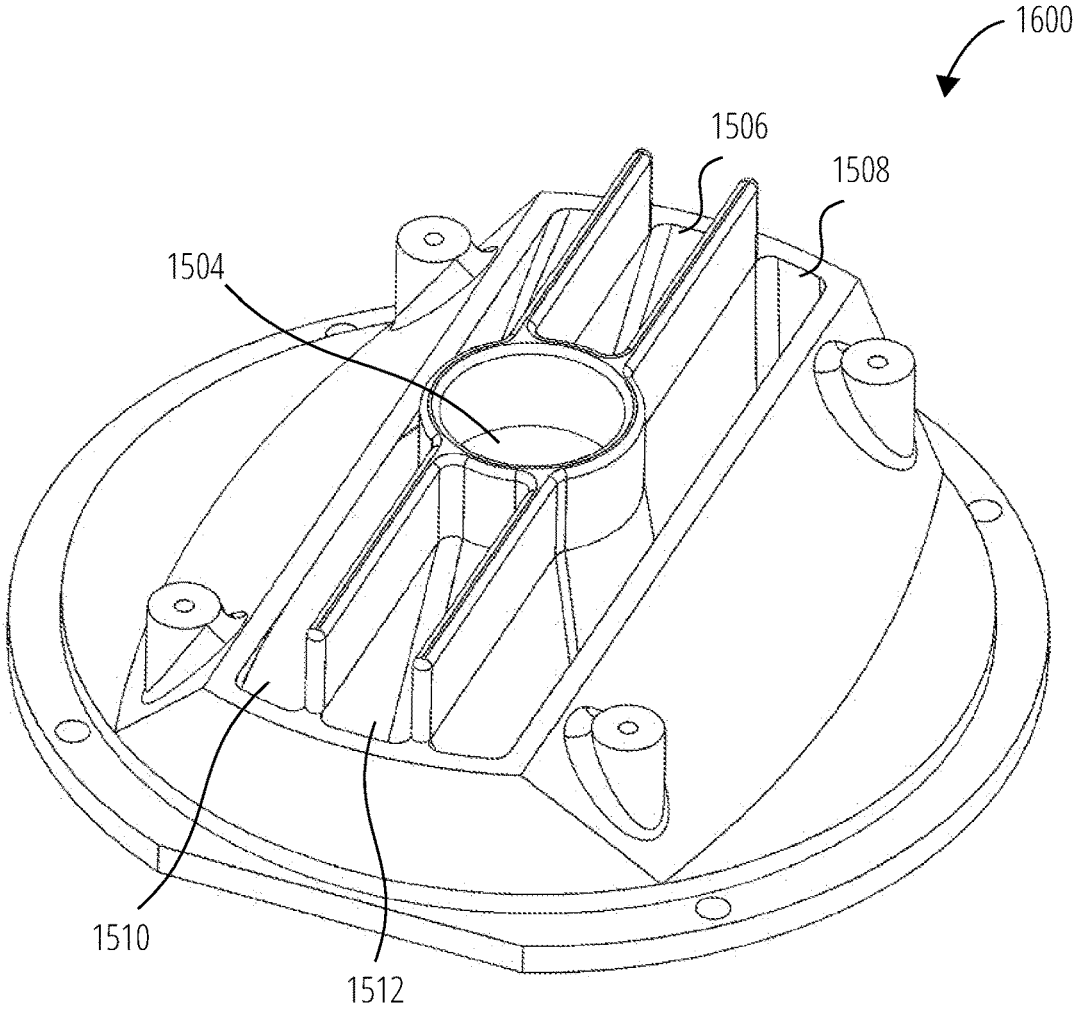

FIG. 16 illustrates generally a perspective outlet-side view of the third lens. The third lens outlet side 1600 comprises the third lens axial passage 1504, the central first peripheral passage 1506, the first peripheral side passage 1508, the second peripheral side passage 1510, and the central second peripheral passage 1512. In an example, the third lens axial passage 1504 can extend through the third lens and can have a substantially frustoconical shape.

Figure 17:
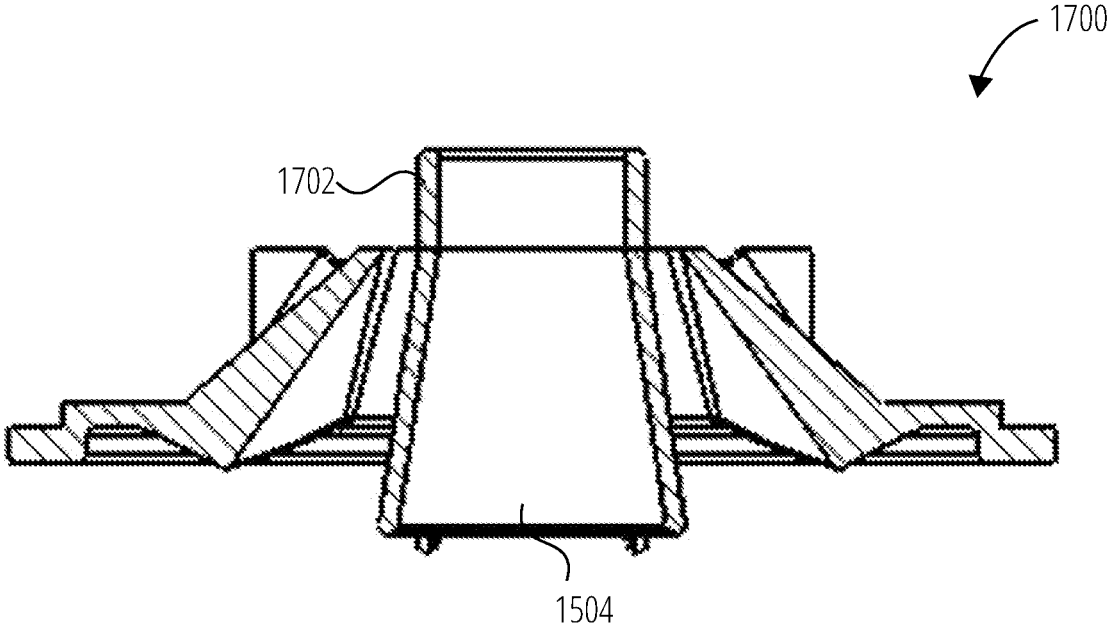

FIG. 17 illustrates generally a third lens cross section view 1700 for the third lens. The example of FIG. 17 includes the third lens axial passage 1504. Unlike other lens examples herein, the third lens is relatively open in that it does not include or use a relatively high percentage of cone area cutoff. That is, the third lens does not include rigid or acoustic transmission-inhibiting features or walls over a large surface area portion of its body. Instead, the third lens is configured to sample or receive information from a relatively large portion of an adjacent cone area of a transducer and then direct such information through a slotted area with relatively thin sidewalls or vanes. In an example, the third lens can include or use passages having various sidewall or width characteristics. For example, some of the passages can expand and contract over a thickness direction of the lens, and others can expand (e.g., from the acoustic inlet side to the acoustic outlet side, or vice versa).

In the example of the third lens in FIGS. 15-17, at least one of the passage sidewalls can extend in the acoustic outlet direction, such as into an adjacent horn or waveguide. For example, FIG. 17 illustrates a passage wall extension 1702, or diffraction blades, such as in or around the third lens axial passage 1504, that extends in the waveguide direction and beyond the other passage walls. One or more of the other passage walls can be similarly made to extend into a horn or waveguide. Conversely, one or more portions of the passage walls can be shortened so as not to extend into or not to be adjacent to a plane at which an adjacent waveguide begins.

Figure 18:
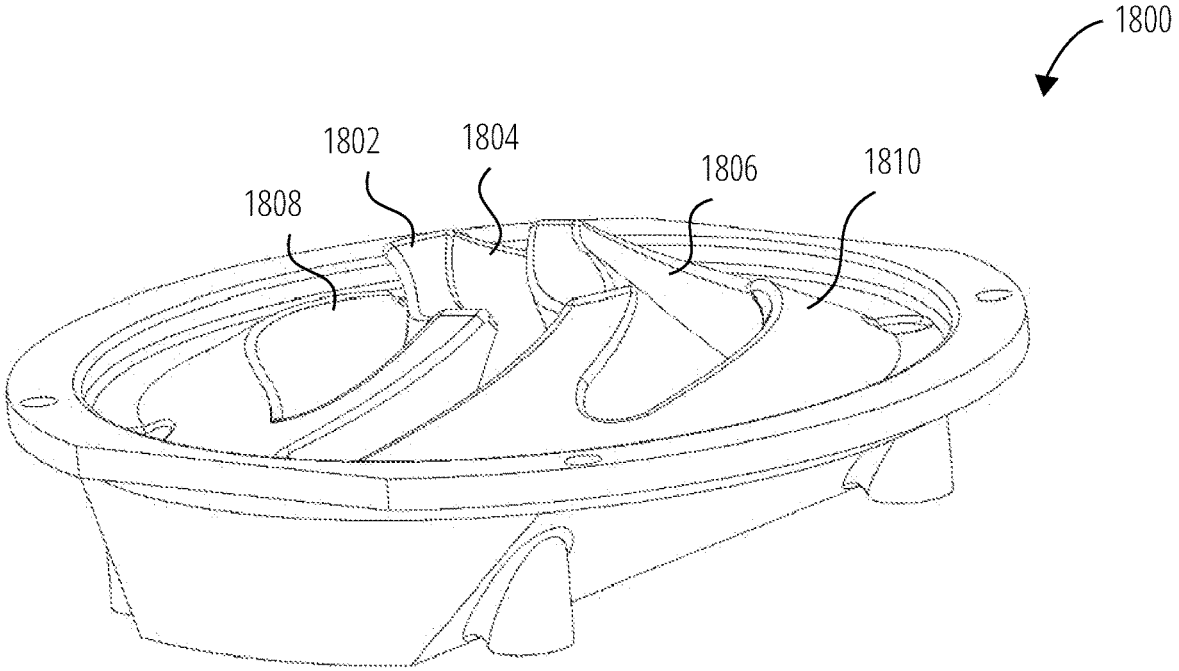
FIGS. 18-20 illustrate generally various views of an example of a fourth lens.
Figure 19:
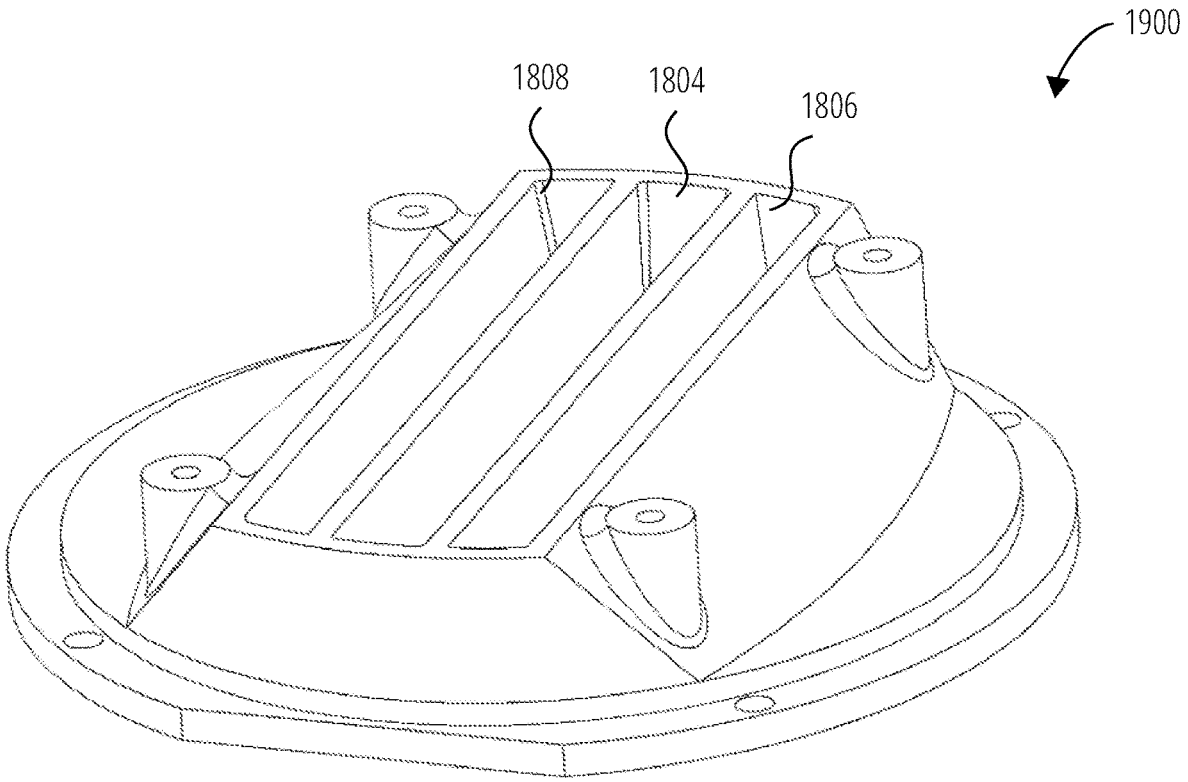
Figure 20:
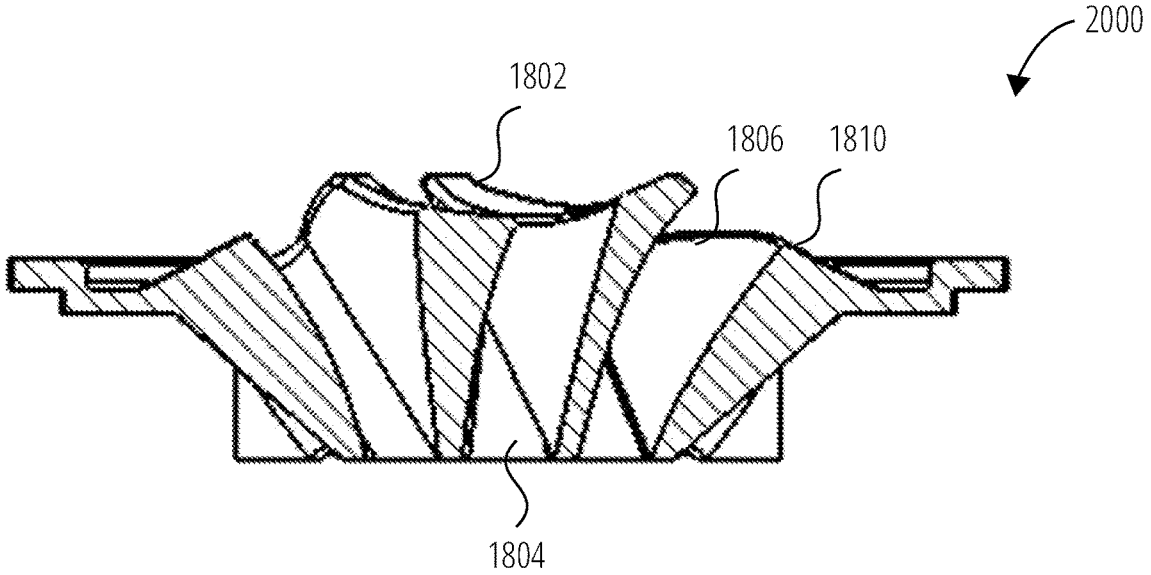

FIG. 18 illustrates generally a perspective inlet-side view of an example of a fourth lens. The example of FIG. 18 includes a fourth lens inlet side 1800 that includes an inlet dome contour 1802, a twisted central passage 1804, a twisted first peripheral passage 1806, a twisted second peripheral passage 1808, and a cone contour 1810. Any one or more of the passages in the fourth lens can have straight or angled or tapered sidewalls, as similarly discussed in other lens examples herein. The various passages facilitate acoustic communication between a transducer that is coupled to a first side of the fourth lens and a waveguide such as can be coupled to an opposite second side of the fourth lens. In the example of FIGS. 18-20, the fourth lens includes passages that are "twisted" or have a screw thread-like shape or path.

FIG. 19 illustrates generally a perspective outlet-side view of the fourth lens. The fourth lens outlet side 1900 comprises the twisted central passage 1804, the twisted first peripheral passage 1806, and the twisted second peripheral passage 1808. Fewer or additional passages can similarly be used.

FIG. 20 illustrates generally a fourth lens cross section view 2000 for the fourth lens. The example of FIG. 20 includes the inlet dome contour 1802, the twisted central passage 1804, the twisted first peripheral passage 1806, and the cone contour 1810. The example of the fourth lens with twisted passages facilitates communication between various different areas around a cone or dust dome of a transducer and an outlet or waveguide. In an example, an inlet-side area characteristic of one or more passages in the fourth lens can be larger than an outlet-side area characteristic for the same one or more passages.

The systems and configurations discussed herein provide various advantages. First, the loudspeaker systems discussed herein can provide lower distortion output relative to conventional cabinet solutions. Second, the loudspeaker systems discussed herein can provide wider acoustic bandwidth relative to conventional cabinet solutions. Third, the loudspeaker systems discussed herein can provide precise dispersion control. Fourth, the loudspeaker systems discussed herein can handle high power input signals. Fifth, the loudspeaker systems discussed herein can be configured for use with instruments or signal chain modelers, such as can have an extended frequency response range. Sixth, the loudspeaker systems discussed herein can be configured for use on stage as a direct source or can be mixed with or using a front of house system. Additionally, the loudspeaker systems discussed herein can be configured to provide a substantially uncolored response such that instrument information or information from a pre-processor or emulator can be faithfully reproduced.

VARIOUS NOTES AND ASPECTS

Various aspects of the present disclosure can be combined or used together.

Aspect 1 can include or use subject matter (such as an apparatus, a system, a device, a method, or a means for performing acts, or an article of manufacture), such as can include or use a substantially full-range loudspeaker system for acoustic sound reinforcement. Aspect 1 can include a woofer section including a first loudspeaker driver configured to reproduce audio signals in a first frequency range, and a controlled-directivity horn section configured to reproduce other audio signals in a different second frequency range. In an example, the horn section can include a second loudspeaker driver comprising a cone-diaphragm transducer and a dust dome, an acoustic lens having a first side and an opposite second side, wherein the first side of the lens is coupled to a sound-projecting face of the second loudspeaker driver, and a waveguide coupled to the second side of the lens, wherein the waveguide comprises walls that follow arcuate paths in horizontal and vertical planes.

Aspect 2 can include or use, or can optionally be combined with the subject matter of Aspect 1, to optionally include the woofer section comprising a planar baffle configured to receive the first loudspeaker driver. In Aspect 2, opposite endpoints of the arcuate path in the vertical plane of the waveguide define a first segment, and a bisector to the first segment in the vertical plane is substantially perpendicular to the planar baffle.

Aspect 3 can include or use, or can optionally be combined with the subject matter of one or any combination of Aspects 1 or 2 to optionally include the woofer section comprising a baffle configured to receive the first loudspeaker driver, and the baffle has a baffle central axis. In Aspect 3, the waveguide has a waveguide central axis in the vertical plane of the waveguide, and the baffle central axis and the waveguide central axis are substantially parallel and transversely spaced apart.

Aspect 4 can include or use, or can optionally be combined with the subject matter of one or any combination of Aspects 1 through 3 to optionally include the woofer section comprising a baffle for the first loudspeaker driver, wherein the baffle is angled relative to a horizontal reference plane such that an acoustic directivity characteristic of the woofer section substantially matches an acoustic directivity characteristic of the horn section at or near a crossover frequency of the first and second frequency ranges.

Aspect 5 can include or use, or can optionally be combined with the subject matter of Aspect 4, to optionally include the crossover frequency is between about 1000 Hz and 2000 Hz.

Aspect 6 can include or use, or can optionally be combined with the subject matter of one or a combination of Aspects 4 and 5, to optionally include the baffle is angled about 18 degrees relative to the horizontal reference plane.

Aspect 7 can include or use, or can optionally be combined with the subject matter of one or any combination of Aspects 1 through 6, to optionally include a vertical angle of the waveguide extends about 36 degrees from the horizontal reference plane.

Aspect 8 can include or use, or can optionally be combined with the subject matter of one or any combination of Aspects 1 through 7 to optionally include the woofer section comprising a pair of loudspeaker drivers coupled to a baffle, and a central axis, or a perpendicular center line, of the baffle extends between the drivers and is parallel to a central axis of the waveguide.

Aspect 9 can include or use, or can optionally be combined with the subject matter of one or any combination of Aspects 1 through 8 to optionally include the first loudspeaker driver offset from a center axis of the loudspeaker system toward a top edge or a bottom edge of the waveguide.

Aspect 10 can include or use, or can optionally be combined with the subject matter of one or any combination of Aspects 1 through 9 to optionally include the waveguide extending in the vertical plane between lower and upper waveguide edges, and the lower edge coincides with a reference horizontal plane. In Aspect 10, the horn section can include multiple cone-diaphragm transducer loudspeaker drivers arranged in the vertical plane of the waveguide, and respective central axes of the drivers can be offset relative to each other and relative to the reference horizontal plane.

Aspect 11 can include or use, or can optionally be combined with the subject matter of one or any combination of Aspects 1 through 10 to optionally include or use a loudspeaker cabinet enclosing the woofer section and the controlled-directivity horn section. In Aspect 11, a sidewall of the cabinet adjacent to the waveguide can follow substantially the same arcuate path as the waveguide in the vertical plane.

Aspect 12 can include or use, or can optionally be combined with the subject matter of one or any combination of Aspects 1 through 11 to optionally include the waveguide having a splay angle of at least about 30 degrees in the vertical plane.

Aspect 13 can include or use, or can optionally be combined with the subject matter of one or any combination of Aspects 1 through 12 to optionally include or use a subwoofer in a subwoofer enclosure, wherein a bottom surface of a loudspeaker cabinet enclosing the woofer section and the controlled-directivity horn section is configured to be coupled with a top surface of the subwoofer enclosure. In Aspect 13, the loudspeaker system is configured to deliver a substantially full-range acoustic signal to one or more listeners when a bottom surface of the subwoofer enclosure is stationed on a first listening environment surface and positioned to deliver acoustic signals to the one or more listeners standing on the first listening environment surface and the listeners are spaced apart from the loudspeaker system by at least 1.2 meters.

Aspect 14 can include or use, or can optionally be combined with the subject matter of one or any combination of Aspects 1 through 13 to optionally include or use an amplifier configured to receive a line-level instrument signal or other signal and, in response, provide amplified drive signals to the first and second loudspeaker drivers.

Aspect 15 can include or use, or can optionally be combined with the subject matter of Aspect 14, to optionally include the amplifier configured to receive a line-level instrument signal from an amplifier modeling device or other audio signal processor device.

Aspect 16 can include or use, or can optionally be combined with the subject matter of one or any combination of Aspects 1 through 15 to optionally include the acoustic lens comprising three elongate slots through which acoustic signals can pass from the second loudspeaker driver to the waveguide.

Aspect 17 can include or use, or can optionally be combined with the subject matter of one or any combination of Aspects 1 through 16 to optionally include at least a portion of the first side of the lens having a contoured surface that mirrors a corresponding surface of the diaphragm and the dust dome of the second loudspeaker driver.

Aspect 18 can include or use, or can optionally be combined with the subject matter of Aspect 17, to optionally include the lens comprising a first elongate slot provided axially above a center of the dust cap.

Aspect 19 can include or use, or can optionally be combined with the subject matter of Aspect 18, to optionally include or use an aperture of the first elongate slot on the first side of the lens having a first area characteristic and an aperture of the first elongate slot on the second side of the lens having a lesser second area characteristic.

Aspect 20 can include or use, or can optionally be combined with the subject matter of Aspect 18 or Aspect 19, to optionally include the first elongate slot comprising sidewalls that extend from the first side of the lens to the second side of the lens along a slanted path toward an axis of the second loudspeaker driver.

Aspect 21 can include or use, or can optionally be combined with the subject matter of one or any combination of Aspects 1 through 20 to optionally include the horn section further including a third loudspeaker driver, and wherein the acoustic lens comprises respective lens instances coupled to the second and third loudspeaker drivers and to the waveguide.

Aspect 22 can include or use, or can optionally be combined with the subject matter of Aspect 21, to optionally include the sound-projecting faces of the second and third loudspeaker drivers are arranged along an arcuate path in the vertical plane of the waveguide.

Aspect 23 can include or use subject matter (such as an apparatus, a system, a device, a method, or a means for performing acts, or an article of manufacture), such as can include or use a loudspeaker horn comprising a plurality of electroacoustic drivers for generating sound waves over a range of frequencies, each driver having a central axis and a sound-projecting face, and a plurality of acoustic lenses extending from an inlet to an outlet, wherein inlets of respective lenses are acoustically coupled to the sound-projecting faces of respective drivers. Aspect 23 can include a waveguide coupled to the outlets of each of the acoustic lenses. In an example, at least one of the lenses comprises an aperture that is coaxial with a central axis of a first one of the drivers, and the aperture can have a greater cross-sectional area at its inlet than at its outlet.

Aspect 24 can include or use, or can optionally be combined with the subject matter of Aspect 23, to optionally include the inlets of the plurality of acoustic lenses are disposed on an arcuate line in a first plane, for example, on or along a vertical central cross section of the waveguide.

Aspect 25 can include or use, or can optionally be combined with the subject matter of one or any combination of Aspects 23 or 24, to optionally include axes of the plurality of acoustic lenses forming an arcuate array with a point of convergence on a driver side of the horn.

Aspect 26 can include or use, or can optionally be combined with the subject matter of one or any combination of Aspects 23 through 25 to optionally include a first one of the lenses comprising a first elongate slot provided coaxially with a corresponding first one of the drivers.

Aspect 27 can include or use, or can optionally be combined with the subject matter of Aspect 26, to optionally include an aperture of the first elongate slot on a driver-facing side of the lens having a first area characteristic and an aperture of the first elongate slot on an acoustic-projection side of the lens having a lesser second area characteristic.

Aspect 28 can include or use subject matter (such as an apparatus, a system, a device, a method, or a means for performing acts, or an article of manufacture), such as can include or use an acoustic lens for use with a cone-diaphragm loudspeaker transducer, the lens comprising a sound-receiving first side having a surface contour that substantially mirrors a contour of at least a portion of a diaphragm of the loudspeaker transducer when the lens is provided adjacent to the loudspeaker transducer, and a sound-projected second side opposite the first side. Aspect 28 can include a first slot provided coaxially with a central axis of the loudspeaker transducer and configured to provide an acoustic path from the first side to the second side of the lens, wherein an aperture of the first slot on the first side of the lens has a greater area characteristic than an aperture of the first slot on the second side of the lens.

Aspect 29 can include or use, or can optionally be combined with the subject matter of Aspect 28, to optionally include the surface contour of the first side comprising a concave contour portion adjacent to the slot, wherein the concave contour portion corresponds to a convex contour of a dust dome of the loudspeaker transducer.

Aspect 30 can include or use, or can optionally be combined with the subject matter of one or any combination of Aspects 28 and 29 to optionally include peripheral slots adjacent to the first slot.

Aspect 31 can include or use, or can optionally be combined with the subject matter of one or any combination of Aspects 28 through 30 to optionally include at least two opposite sidewalls of the first slot are substantially linear and sloped from the first side of the lens toward the central axis of the loudspeaker.

Aspect 32 can include or use, or can optionally be combined with the subject matter of one or any combination of Aspects 28 through 31 to optionally include or use second and third elongate slots provided on opposite sides of the first slot, wherein the first slot includes a pair of tapered sidewalls and wherein the second and third slots have respective pairs of sidewalls that are substantially parallel.

Aspect 33 can include or use, or can optionally be combined with the subject matter of one or any combination of Aspects 28 through 32 to optionally include or use second and third elongate slots provided on opposite sides of the first slot, wherein each of the first, second, and third slots is tapered in a sound-projecting direction of the lens.

Each of these non-limiting aspects can stand on its own or can be combined in various permutations or combinations with one or more of the other examples.

The above description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

Geometric terms, such as "parallel", "perpendicular", "round", or "square", are not intended to require absolute mathematical precision, unless the context indicates otherwise. Instead, such geometric terms allow for variations due to manufacturing or equivalent functions. For example, if an element is described as "round" or "generally round," a component that is not precisely circular (e.g., one that is slightly oblong or is a many-sided polygon) is still encompassed by this description.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

What is claimed is:

1. A substantially full-range loudspeaker system for acoustic sound reinforcement, the system comprising:

a woofer section including a first loudspeaker driver configured to reproduce audio signals in a first frequency range; and a controlled-directivity horn section configured to reproduce other audio signals in a different second frequency range, the horn section including:

a second loudspeaker driver comprising a cone-diaphragm transducer and a dust cap;

an acoustic lens having a first side and an opposite second side coupled by multiple separate acoustic passages through the lens, wherein the first side of the lens includes a contoured surface that is coupled to receive acoustic energy from a sound-projecting face of the second loudspeaker driver; and a waveguide coupled to the second side of the lens to receive the acoustic energy from the loudspeaker driver via the passages in the lens, wherein the waveguide comprises splayed walls that follow arcuate paths in horizontal and vertical planes relative to a central axis of the lens.

2. The loudspeaker system of claim 1, wherein the woofer section comprises a planar baffle configured to receive the first loudspeaker driver; and wherein opposite endpoints of the arcuate path in the vertical plane of the waveguide define a first segment, and a bisector to the first segment in the vertical plane is substantially perpendicular to the planar baffle.

3. The loudspeaker system of claim 1, wherein the woofer section comprises a baffle configured to receive the first loudspeaker driver, and wherein the baffle has a baffle central axis;

wherein the waveguide has a waveguide central axis in the vertical plane of the waveguide; and wherein the baffle central axis and the waveguide central axis are substantially parallel and transversely spaced apart.

4. The loudspeaker system of claim 1, wherein the woofer section comprises a baffle for the first loudspeaker driver;

wherein the baffle is angled relative to a horizontal reference plane such that an acoustic directivity characteristic of the woofer section substantially matches an acoustic directivity characteristic of the horn section at or near a crossover frequency of the first and second frequency ranges.

5. The loudspeaker system of claim 4, wherein the crossover frequency is between about 1000 Hz and 2000 Hz, wherein the baffle is angled about 18 degrees relative to the horizontal reference plane, and wherein a vertical angle of the waveguide extends about 36 degrees from the horizontal reference plane.

6. The loudspeaker system of claim 1, wherein the woofer section comprises a pair of loudspeaker drivers coupled to a baffle, and a central axis of the baffle extends between the drivers and is parallel to a central axis of the waveguide.

7. The loudspeaker system of claim 1, wherein the waveguide extends in the vertical plane between lower and upper waveguide edges, and the lower edge coincides with a reference horizontal plane; and wherein the horn section comprises multiple cone-diaphragm transducer loudspeaker drivers arranged in the vertical plane of the waveguide, and wherein respective central axes of the drivers are offset relative to each other and relative to the reference horizontal plane.

8. The loudspeaker system of claim 1, wherein the contoured surface of the lens mirrors a corresponding surface of the diaphragm and the dust cap of the second loudspeaker driver.

9. The loudspeaker system of claim 8, wherein the acoustic passages through the lens comprise a first elongate slot provided axially above a center of the dust cap, wherein an aperture of the first elongate slot on the first side of the lens has a first area characteristic, and wherein an aperture of the first elongate slot on the second side of the lens has a second area characteristic that is less than the first area characteristic.

10. The loudspeaker system of claim 8, wherein the acoustic passages through the lens comprise a first elongate slot provided axially above a center of the dust cap, wherein the first elongate slot comprises sidewalls that extend from the first side of the lens to the second side of the lens along a slanted path toward a central axis of the second loudspeaker driver.

11. The loudspeaker system of claim 1, wherein the horn section further includes a third loudspeaker driver, and wherein the acoustic lens comprises respective lens instances coupled to the second and third loudspeaker drivers and to the waveguide, and wherein sound-projecting faces of the second and third loudspeaker drivers are arranged along an arcuate path in the vertical plane of the waveguide.

12. A loudspeaker horn comprising:

a plurality of electroacoustic drivers for generating sound waves over a range of frequencies, each driver having a central axis and a sound-projecting face;

a plurality of acoustic lenses extending from an inlet to an outlet, wherein inlets of respective lenses are acoustically coupled to the sound-projecting faces of respective drivers; and a waveguide coupled to the outlets of each of the acoustic lenses;

wherein at least one of the lenses comprises a first acoustic passage and a second acoustic passage, wherein the first acoustic passage is coaxial with a central axis of a first one of the drivers, and wherein the first acoustic passage has a greater cross-sectional area at the lens inlet than at the lens outlet, and wherein the second acoustic passage is peripheral to the first acoustic passage and the second acoustic passage contracts and/or expands along its length from the lens inlet to the lens outlet.

13. The loudspeaker horn of claim 12, wherein the inlets of the plurality of acoustic lenses are disposed on an arcuate line in a vertical central cross section of the waveguide.

14. The loudspeaker horn of claim 12, wherein axes of the plurality of acoustic lenses form an arcuate array with a point of convergence on a driver side of the horn.

15. The loudspeaker horn of claim 12, wherein the first acoustic passage comprises a first elongate slot provided coaxially with a corresponding first one of the drivers, and wherein an aperture of the first elongate slot on a driver-facing side of the lens has a first area characteristic and an aperture of the first elongate slot on an acoustic-projection side of the lens has a lesser second area characteristic.

16. An acoustic lens for use with a cone-diaphragm loudspeaker transducer, the lens comprising:

a sound-receiving first side having a surface contour that substantially mirrors a contour of at least a portion of a diaphragm of the loudspeaker transducer when the lens is provided adjacent to the loudspeaker transducer;

a sound-projecting second side opposite the first side; and a first passage provided substantially coaxially with a central axis of the loudspeaker transducer and configured to provide an acoustic path from the first side to the second side of the lens, wherein an aperture of the first passage on the first side of the lens has a greater area characteristic than an aperture of the first passage on the second side of the lens.

17. The acoustic lens of claim 16, wherein the surface contour of the first side comprises a concave contour portion adjacent to the passage, wherein the concave contour portion corresponds to a convex contour of a dust dome of the loudspeaker transducer.

18. The acoustic lens of claim 16, wherein at least two opposite sidewalls of the first passage are substantially linear and sloped from the first side of the lens toward the central axis of the loudspeaker.

19. The acoustic lens of claim 16, further comprising second and third elongate passages provided on opposite sides of the first passage, wherein the first passage includes a pair of tapered sidewalls and wherein the second and third passages have respective pairs of sidewalls that are substantially parallel.

20. The acoustic lens of claim 16, further comprising second and third elongate passages provided on opposite sides of the first passage, wherein each of the first, second, and third passages is tapered in a sound-projecting direction of the lens.

* * * * *